US007748838B2

(12) United States Patent
Oishi

(10) Patent No.: US 7,748,838 B2
(45) Date of Patent: Jul. 6, 2010

(54) INKJET DRAWING METHOD AND INKJET DRAWING DEVICE

(75) Inventor: Chikashi Oishi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 750 days.

(21) Appl. No.: 11/654,655

(22) Filed: Jan. 18, 2007

(65) Prior Publication Data

US 2007/0165093 A1 Jul. 19, 2007

(30) Foreign Application Priority Data

Jan. 18, 2006 (JP) ..... 2006-010474

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 2003/0222961 | A1 | 12/2003 | Nakajima | |
| 2005/0185040 | A1 | 8/2005 | Nagashima | |
| 2007/0013757 | A1 * | 1/2007 | Ohnishi | 347/102 |

FOREIGN PATENT DOCUMENTS

| | | |
|---|---|---|
| EP | 1 629 979 | 3/2006 |
| JP | 2004-322560 | 11/2004 |
| JP | 2004-358769 | 12/2004 |

OTHER PUBLICATIONS

Extended European Search Report dated Apr. 11, 2007.

* cited by examiner

*Primary Examiner*—Julian D Huffman
(74) *Attorney, Agent, or Firm*—Sughrue Mion, PLLC

(57) ABSTRACT

The inkjet drawing device and method form an image on an image recording medium relatively transported in a sub-scanning direction perpendicular to a main scanning direction by using photocurable ink with an inkjet head moving in the main scanning direction. The device and method cause the inkjet head to eject the photocurable ink as an ink droplet imagewise to perform direct drawing, irradiate an upper portion of the image recording medium with active light from a stationary, point or substantially point active light source by using a scanning mirror that scans and moves in the main scanning direction at a backward position distant from a position subjected to the drawing by the inkjet head by a predetermined distance toward a sub-scanning transport downstream side of the image recording medium and cure the photocurable ink ejected onto the image recording medium imagewise to form the image.

18 Claims, 5 Drawing Sheets

INKJET DRAWING METHOD AND INKJET DRAWING DEVICE

The entire contents of the document cited in this specification are herein incorporated by reference.

BACKGROUND OF THE INVENTION

The present invention relates to an inkjet drawing method and an inkjet drawing device for recording an image on a sheet-like image recording medium by an inkjet recording method, and in particular, to an inkjet drawing method and an inkjet drawing device for forming an image on, for example, a lithographic printing base plate for use in, for example, a plate making apparatus for producing a printing plate for lithography by an inkjet recording method.

In lithography, a surface of a printing plate is provided with a printing ink receiving (i.e., ink receptive) region and a printing ink repulsive (i.e., ink repellent) region in correspondence with an original image, and printing is performed by causing printing ink to adhere to the ink receiving region. In ordinary cases, a hydrophilic (i.e., ink repellent) region and a lipophilic (i.e., ink receiving or ink receptive) region are formed imagewise on the surface of a printing plate, and the hydrophilic region is made ink repulsive (i.e., ink repellent) by using dampening water.

A printing plate on which an image is formed has been conventionally produced (i.e., prepared) for each color according to the following procedure. When an original is a monochromatic original, a silver salt photographic film (e.g., lith film) is exposed and developed in an analog or digital manner to output a film plate bearing an image included in the original as it is. When the original is a color original, the original is subjected to color separation into, for example, the respective colors of C (cyan), M (magenta), Y (yellow), and K (black), and a silver salt photographic film is exposed and developed for each color in an analog or digital manner to output a film plate bearing an image of each color included in the original. The film plate is used to expose a diazo resin or a photopolymer photosensitive material (presensitized plate). Then, for example, a non-image area is dissolved and removed by using mainly an alkali solution, whereby the printing plate is produced.

With the improvement in digital drawing technology and a demand for an improvement in efficiency of a plate making process, a large number of systems each capable of directly drawing digital image information on a presensitized plate (i.e., plate in which a photosensitive layer, a heat-sensitive layer, or the like is formed on a printing base plate) have been proposed in recent years. A known example of such system capable of directly drawing digital image information on a presensitized plate is a system that records an image on, for example, the photosensitive layer or heat-sensitive layer of a printing base plate by using laser in an optical mode or a thermal mode, However, in this plate making method, plate making is generally performed by dissolving and removing a non-image area through the treatment (of, for example, the photosensitive layer or heat-sensitive layer) of the exposed printing base plate with an alkali developer after laser recording in each of the optical mode and the thermal mode. The discharge of an alkali waste liquid as it is is not preferable in terms of environmental protection, so the disposal of the alkali waste liquid is needed. In addition, a method involving the use of laser requires an expensive and large device.

In order to solve the problem, there has been attempted to use an inkjet recording method which is an inexpensive and compact drawing mode. The direct formation of an image on a printing base plate by an inkjet recording method results in the production of a printing plate without, for example, dissolving or removing a non-image area. In addition, a device using the above method can be small.

JP 2004-322560 A and JP 2004-358769 A each disclose, as a recording device that employs an inkjet recording method, an inkjet printer using ultraviolet (UV) curable ink (hereinafter referred to as "UV ink") which is of such a type that the UV ink is ejected as an ink droplet from an inkjet head. The inkjet printer using the UV ink has, on a side of an inkjet head, UV irradiation means for radiating ultraviolet light to a UV ink droplet ejected from the inkjet head and caused to impinge on the surface of a print medium to cure the UV ink droplet. Immediately after the UV ink has been caused to impinge as a droplet on the surface of the print medium as described above, ultraviolet light is radiated from the UV irradiation means to the impinged UV ink droplet to dry and cure the UV ink quickly, whereby an image is formed on the print medium.

The inkjet printer disclosed in JP 2004-322560 A includes therein a UV lamp that generates high heat as the UV irradiation means. Accordingly, in order that a printer portion to be irradiated with UV light radiated from the UV lamp which is the UV irradiation means may be prevented from being heated to a high temperature at a position where each of the inkjet head and the UV irradiation means is on standby, cooling means for cooling a cover on which UV light radiated through a window in the bottom surface of the UV irradiation means impinges is provided.

On the other hand, in the device disclosed in JP 2004-358769 A, a UVLED or UVLED array is used as the UV irradiation means, whereby the drawbacks of a UV lamp such as a high-pressure mercury lamp or a metal halide lamp which is large and consumes large electric power, i.e., generates high heat are eliminated, the energy consumption of the UV irradiation means is reduced, and a reduction in size of the UV irradiation means is achieved. In addition, JP 2004-358769 A discloses an example of a constitution in which an inkjet head and the UV irradiation means are integrated to be moved, and an example of a constitution in which they are moved as separate bodies.

SUMMARY OF THE INVENTION

When the inkjet printer disclosed in JP 2004-322560 A which has the UV irradiation means such as a UV lamp on a side of the inkjet head is applied to a plate making apparatus using a printing base plate as a recording medium (i.e., print medium), in order that UV ink may be cured immediately after drawing near a position where an image is drawn by the inkjet head, UV light including a thermal component is radiated from the UV lamp to the printing base plate, and the printing base plate receives heat from the high-heat UV lamp. As a result, the following problem arises: the printing base plate which has been irradiated with high-heat UV light and has received heat from the high-heat UV lamp undergoes thermal expansion owing to heating at the drawing (i.e., recording) position to deform, and, if the deformation is large, the displacement of the image on the printing base plate occurs.

In addition, the displacement of a position where an image is formed on the printing base plate is particularly problematic in the case of multi color printing in which an image is formed by using multiple printing plates because a color shift occurs.

On the other hand, when the inkjet printer disclosed in JP 2004-358769 A which uses a UVLED or UVLED array as the UV irradiation means is applied to a plate making apparatus, an energy consumption is small irrespective of whether the inkjet head and the UV irradiation means are integrated or separated bodies, so the UVLED itself does not involve a problem of heat generation, and the size of a device constitution can be reduced. However, there arises a problem in that the device is expensive.

An object of the present invention is to provide an inkjet drawing method and an inkjet drawing device which: solve the above-mentioned problems of the conventional techniques; can perform scanning and irradiation with active light emitted from a low-cost, point or substantially point active light source without waste or loss; and, even when the deformation of an image recording medium such as a lithographic printing base plate due to thermal expansion occurs as a result of irradiation with active light including a thermal component or the reception of heat from a high-heat active light source, can eliminate an influence of the deformation on the accuracy of an image to be drawn to form an image having high accuracy of position.

To achieve the above-mentioned object, according to a first aspect of the present invention, there is provided an inkjet drawing device for recording an image on a sheet-like image recording medium by an inkjet recording method, the inkjet drawing device including: a support for supporting the image recording medium; an inkjet head for ejecting photocurable ink as an ink droplet imagewise onto the image recording medium placed on the support, the inkjet head being disposed to be opposed to the support; a head moving mechanism for moving the inkjet head in a main scanning direction; a scanning active light irradiation section for scanning and irradiating the image recording medium with an active light beam in the main scanning direction to cure the photocurable ink ejected onto the image recording medium, the scanning active light irradiation section being disposed to be opposed to the support and to be on a transport downstream side of the image recording medium so that the scanning active light irradiation section is distant from the inkjet head by a predetermined distance; and a transport mechanism for transporting the image recording medium in a sub-scanning direction substantially perpendicular to the main scanning direction relative to the inkjet head, and in the inkjet drawing device, the scanning active light irradiation section has a point or substantially point active light source for emitting the active light beam, parallel light producing means for producing the active light beam emitted from the active light source as parallel light parallel to a recording surface of the image recording medium supported by the support, a scanning mirror which reflects the parallel light produced by the parallel light producing means toward a side of the image recording medium and which is movable in the main scanning direction, and a mirror movement mechanism for moving the scanning mirror in the main scanning direction.

The active light beam is ultraviolet (UV) light, visible light, infrared light, or the like. In addition, the photocurable ink refers to ink that is cured by being irradiated with the active light beam.

In addition, it is preferable that: ultraviolet (UV) light be used as the active light beam; and ultraviolet curable ink (UV ink) be used as the photocurable ink.

In addition, it is preferable that the mirror movement mechanism have two transport rollers disposed on both sides outside the image recording medium in the main scanning direction, an endless belt which is suspended between the two transport rollers and to which the scanning mirror is attached while being slanted by a predetermined angle, and an irradiation window which is formed to be adjacent to a position where the scanning mirror is attached in a belt portion of the endless belt on the side of the image recording medium and through which irradiation light reflected by the scanning mirror is transmitted.

In addition, it is preferable that: the scanning active light irradiation section further have two mirror surface plates which are disposed on both sides of the endless belt in the sub-scanning direction and inner portions of which are opposed to each other and constitute mirror surfaces; the parallel light producing means have a reflector having an emission port with a rectangular sectional shape for emitting the active light beam emitted from the active light source as the parallel light with the rectangular sectional shape; the active light source and the reflector be disposed between two parallel belt portions of the endless belt and outside the image recording medium in the main scanning direction; inner portions opposed to each other of the two parallel belt portions of the endless belt constitute mirror surfaces; the scanning mirror be attached inside a belt portion on a side of the support out of the two belt portions while being slanted by the predetermined angle; the irradiation window be formed at a position of the belt portion on the side of the support through which the irradiation light reflected by the scanning mirror is transmitted; and a waveguide with a rectangular sectional shape for guiding the parallel light with the rectangular sectional shape emitted from the emission port of the reflector be formed between the two parallel belt portions of the endless belt and between the two mirror surface plates.

In addition, it is preferable that the endless belt be a stainless belt in which the inner portions opposed to each other of the two belt portions are the mirror surfaces.

In addition, it is preferable that the inkjet-drawing device further include: an irradiation section moving mechanism for moving the scanning active light irradiation section in the sub-scanning direction relative to the inkjet head; and a controller for controlling the irradiation section moving mechanism, or the head moving mechanism and the irradiation section moving mechanism so that the scanning active light irradiation section and the inkjet head are distant from each other by the predetermined distance or longer.

In addition, it is preferable that the transport mechanism be a mechanism for transporting the image recording medium in the sub-scanning direction.

In addition, it is preferable that the transport mechanism be a mechanism on which the inkjet head, the head moving mechanism, and the scanning active light irradiation section are mounted and by which they are integrally moved in the sub-scanning direction.

In addition, it is preferable that the image recording medium on which the image is recorded be a lithographic printing plate.

In addition, it is preferable that: the image recording medium be a lithographic printing base plate; and the inkjet drawing device further include a plate surface protective solution ejection head for ejecting a plate surface protective solution onto the printing base plate subjected to drawing by the inkjet head.

In addition, in order to achieve the above-mentioned object, according to a second aspect of the present invention, there is provided an inkjet drawing method for directly forming an image on a sheet-like image recording medium relatively transported in a sub-scanning direction perpendicular to a main scanning direction by using photocurable ink with a serial type inkjet (print) head moving in the main scanning direction, the inkjet drawing method including: causing the inkjet head to eject the photocurable ink as an ink droplet imagewise to perform direct drawing; irradiating an upper portion of the image recording medium with active light from a stationary, point or substantially point active light source by using a scanning mirror that scans and moves in the main scanning direction at a backward position distant from a position subjected to the drawing by the inkjet head by a predetermined distance toward a sub-scanning transport downstream side of the image recording medium; and curing the photocurable ink ejected onto the image recording medium imagewise to form the image.

In each of the above-mentioned first and second aspects, it is preferable that the predetermined distance be a distance in which an influence of heat by the active light source does not affect the drawing by the inkjet head.

In addition, it is preferable that the predetermined distance be determined in accordance with at least one of a speed of the drawing by the inkjet head, kinds or structures of the inkjet head and the active light source, a speed at which the image recording medium is transported in the sub-scanning direction relative to the inkjet head, a material or quality of material of the image recording medium, and a quantity of the active light beam applied from the active light source.

In addition, it is preferable that the controller change a moving speed of the scanning mirror on the basis of a quantity of light emitted from the active light source.

In addition, it is preferable that the controller change the moving speed of the scanning mirror in multiple stages.

In addition, it is preferable that the irradiation section moving mechanism move the active light source or the scanning active light irradiation section at a speed different from a relative moving speed between the image recording medium and the inkjet head.

In addition, it is preferable that the printing plate have a hydrophilic layer and an ink receiving layer in the stated order on an aluminum support having an anodized layer.

According to the first and second aspects of the present invention, the photocurable ink ejected imagewise onto the image recording medium is cured by being irradiated with the active light emitted from the stationary active light source by using the scanning mirror that moves for scanning in the main scanning direction at the backward position distant from the position subjected to the drawing by the inkjet head by the predetermined distance toward the sub-scanning transport downstream side of the image recording medium, so that the image is formed. As a result, scanning and irradiation can be performed with active light emitted from a low-cost, point or substantially point active light source without waste or loss. In addition, even when the deformation of an image recording medium such as a lithographic printing base plate due to thermal expansion occurs as a result of irradiation with active light including a thermal component or the reception of heat from a high-heat active light source, an influence of the deformation on the accuracy of an image to be drawn can be eliminated, whereby a high-quality, high-definition image having high accuracy of position can be formed.

In addition, according to the present invention, the active light source can be made stationary, so the photocurable ink can be quickly dried and cured even when a low-cost, point or substantially point ultraviolet light source having low resistance against vibration is used. For example, photocurable ink such as ultraviolet curable ink can be quickly dried and cured even when a low-cost point light source such as an ultra-high pressure mercury lamp in which an electrode bends owing to vibration or an arc position shifts to make a bulb apt to break is used.

In addition, in the case where the active light source or the scanning active light irradiation section is moved in the sub-scanning direction relative to the inkjet head, the predetermined distance between the position subjected to the drawing by the inkjet head and the position to be scanned and irradiated with the active light by the scanning mirror in the sub-scanning direction can be adjusted. As a result, the time period for which an image recording medium such as a printing base plate is irradiated with the active light (light beam) can be adjusted, whereby photocurable ink on the printing base plate can be suitably cured.

DETAILED DESCRIPTION OF THE PREFERRED EMBODIMENT

An inkjet drawing method and an inkjet drawing device according to the present invention will be described in detail below on the basis of preferred embodiments shown in the attached drawings.

Figure 1:
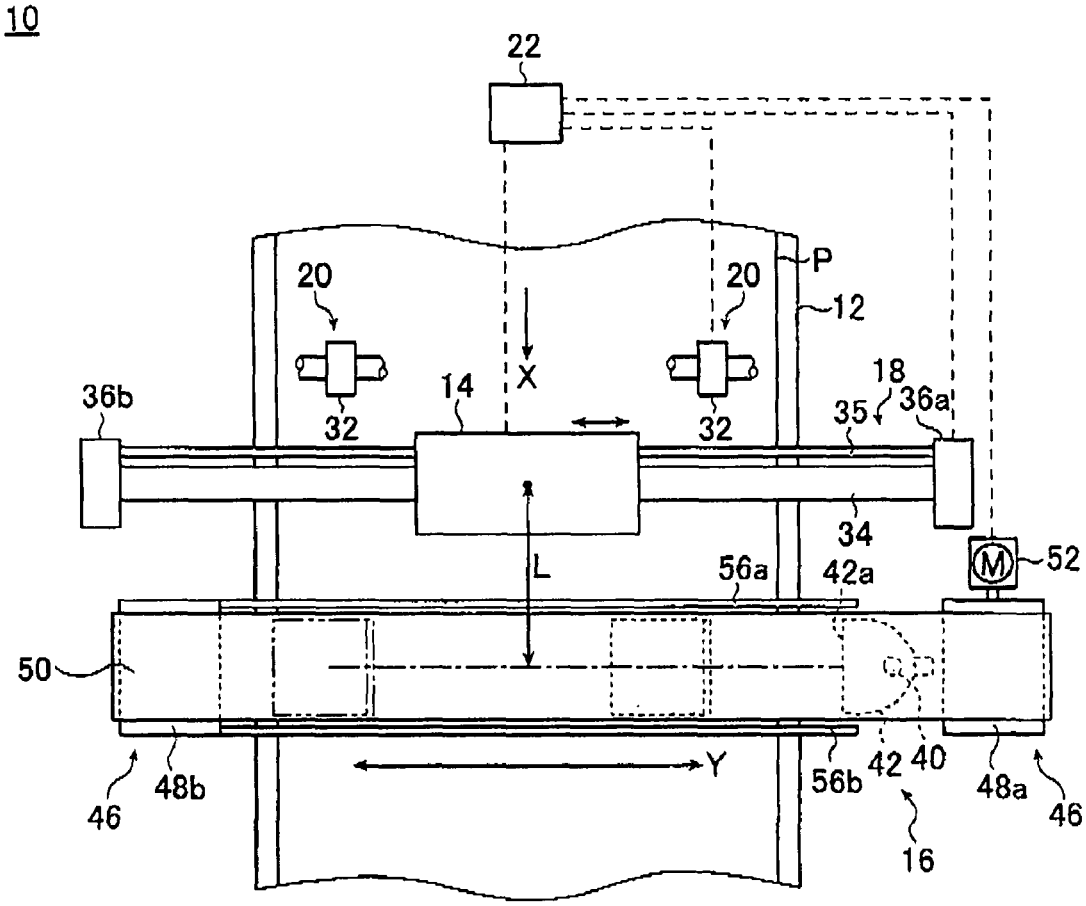
FIG. 1 is a schematic top view showing a schematic constitution of an embodiment of a plate making apparatus to which an inkjet drawing device according to the present invention is applied.
Figure 2:
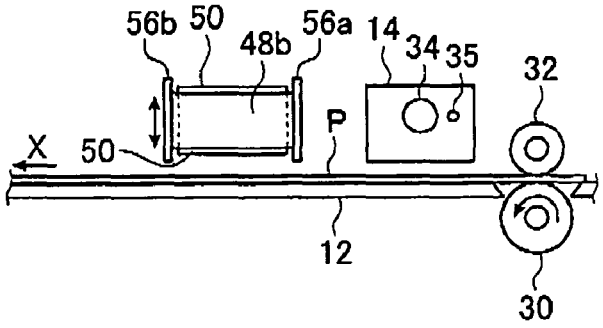
FIG. 2 is a schematic cross sectional view of the plate making apparatus shown in FIG. 1.
Figure 3A:
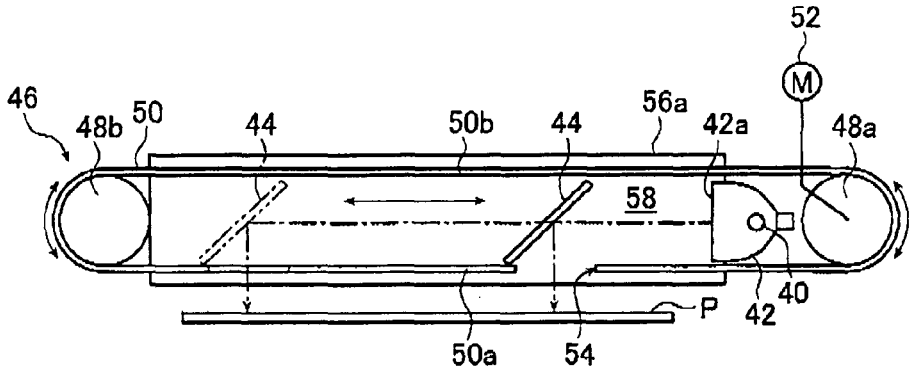
FIGS. 3A and 3B are a schematic cross sectional view and a schematic partially broken cross sectional view of the scanning UV irradiation section of the plate making apparatus shown in FIG. 1, respectively.
Figure 3B:
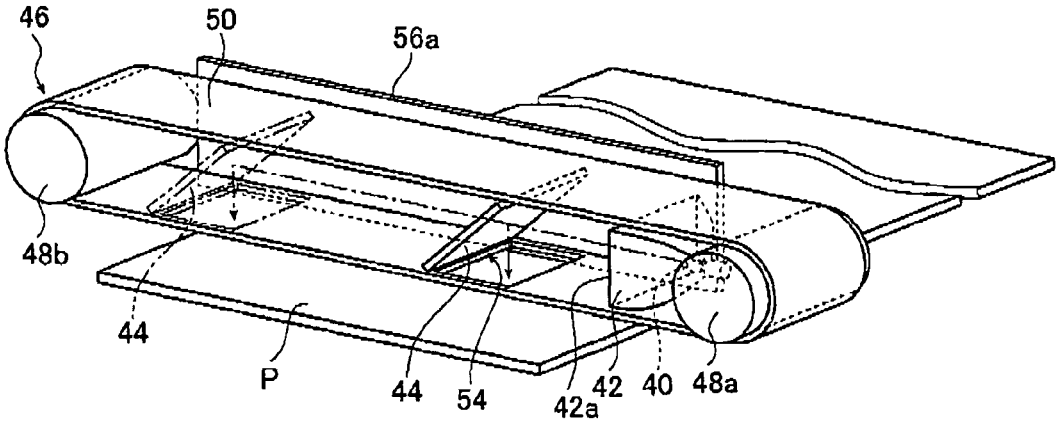

FIG. 1 is a schematic top view showing the schematic constitution of an embodiment of a plate making apparatus to which the inkjet drawing device according to the first aspect of the present invention for performing the inkjet drawing method according to the second aspect of the present invention is applied. FIG. 2 is a schematic cross sectional view of the plate making apparatus shown in FIG. 1. FIGS. 3A and 3B are a schematic cross sectional view and a schematic partially broken cross sectional view of the scanning UV irradiation section of the plate making apparatus shown in FIG. 1, respectively.

Hereinafter, a plate making apparatus for producing a printing plate by using a lithographic printing base plate as an image recording medium, ultraviolet curable ink (hereinafter referred to as "UV ink") as photocurable ink, ultraviolet light (beam) (hereinafter referred to as "UV light") as active light, and an ultraviolet lamp (hereinafter referred to as "UV lamp")

as a point or substantially point active light source will be described as a representative example. Needless to say, the present invention is not limited to this.

An inkjet drawing device for forming a printing ink receiving (i.e., ink receptive) image area on the recording surface of a sheet-like printing base plate P by an inkjet recording method is applied to a plate making apparatus 10 shown in FIGS. 1 and 2. The plate making apparatus 10 includes: a support 12 for supporting the printing base plate P; an inkjet head 14 for ejecting photocurable ink imagewise onto the printing base plate P; a scanning UV (ultraviolet light or ultraviolet ray) irradiation section 16 for scanning and irradiating the photocurable ink ejected onto the printing base plate P with UV light in a main scanning direction (i.e., direction indicated by the arrow Y shown in FIG. 1); a head moving mechanism 18 for moving the inkjet head 14 in the Y direction as the main scanning direction; a transport mechanism 20 for transporting the printing base plate P supported by the support 12 in a sub-scanning direction (i.e., direction indicated by the arrow X shown in FIGS. 1 and 2) substantially perpendicular to the main scanning direction (i.e., Y direction); and a controller 22 for controlling the operation of each of the inkjet head 14, the scanning UV irradiation section 16, the head moving mechanism 18, and the transport mechanism 20.

The support 12 has a flat plate shape, and supports the printing base plate P supplied from an automatic plate feeding device (not shown) on its surface. The surface of the support 12 is preferably provided with an air suction hole to attract the printing base plate P during drawing by the inkjet head 14. In this case, the flatness of the printing base plate P can be properly maintained. In addition, upon transport of the printing base plate P by the transport mechanism 20 in the sub-scanning direction (i.e., X direction), friction between the surface of the support 12 and the back surface of the printing base plate P is preferably small. The support 12 is attached to a not shown plate making apparatus casing.

The transport mechanism 20 transports the printing base plate P in the sub-scanning (X) direction relative to the inkjet head 14. The transport mechanism includes a feeding roller 30 as a driving roller to be connected to a not shown driving source and a holding roller 32 as a driven roller. The transport mechanism nips the printing base plate P between the feeding roller 30 and the holding roller 32, and transports the plate in the sub-scanning (X) direction. The feeding roller 30 and the holding roller 32 are disposed to sandwich the transport path of the printing plate P vertically. The printing base plate P supplied from the automatic plate feeding device is nipped between the feeding roller 30 and the holding roller 32 at a predetermined nip pressure. The feeding roller 30 is rotated in a predetermined direction (i.e., counterclockwise in FIG. 2) by the not shown driving source, whereby the plate is transported in the sub-scanning (X) direction.

When the printing base plate P is attracted to the surface of the support 12 during drawing by the inkjet head 14, the following constitution is preferable: the feeding roller 30 and the holding roller 32 stop rotating during drawing by the inkjet head 14, and, while the inkjet head 14 does not perform drawing, the feeding roller 30 is rotated by the not shown driving source to transport the printing base plate P nipped between the feeding roller 30 and the holding roller 32 in the sub-scanning (X) direction. That is, the transport mechanism 20 preferably transports the printing base plate P in the sub-scanning direction in an intermittent manner. The feeding roller 30 and the holding roller 32 are both rotatably supported by the not shown plate making apparatus casing.

The transport mechanism 20 to be used in the present invention is not limited as long as it can transport the printing base plate P in the sub-scanning direction, and all known sub-scanning transport mechanisms are applicable.

The inkjet head 14 is disposed above the recording surface of the printing base plate P in the figure so as to be opposed to the support 12. The inkjet head 14 is supported by the head moving mechanism 18 to be described later in a state where the head can reciprocate (i.e., scan) in the main scanning (Y) direction parallel to the surface of the support 12.

The inkjet head 14 ejects the UV ink as an ink droplet imagewise onto the recording surface of the printing base plate P placed on the support 12, that is, ejects the UV ink in accordance with an ejection signal based on image data of an image to be recorded to record the image on the printing base plate P, thereby forming an ink receptive image area. The term "ejection signal" as used herein refers to an ejection signal for causing the droplet to be ejected on the basis of an image data signal of the image to be recorded so that the ink is selectively applied to an area serving as the image area. The recording surface of the printing base plate P shows ink repellency (i.e., hydrophilicity), but only the image area formed by the ejection of the UV ink shows ink receptivity (i.e., hydrophobicity).

A continuous or drop-on-demand inkjet head (i.e., ejection head) according to any one of various modes such as a piezoelectric mode, a thermal mode, a solid mode, and an electrostatic suction mode can be used as the inkjet head 14. A drop-on-demand inkjet head according to any one of the various modes is particularly preferably used. An example of an inkjet head that can be suitably used in the present invention will be described in detail later.

The head moving mechanism 18 causes the inkjet head 14 to reciprocate (scan) in the main scanning direction, and comprises a drive screw 34, a guide rail 35, a driving support part 36*a*, and a support part 36*b*.

Each of the drive screw 34 and the guide rail 35 is disposed so as to be parallel to the main scanning direction (i.e., Y direction shown in FIG. 1) perpendicular to the direction in which the printing base plate P is transported (i.e., X direction shown in FIG. 1), and to extend across the left end and right end of the printing base plate P having the maximum size that can be used.

The drive screw 34 includes, for example, a ball screw (not shown) having a male screw portion that is screwed into a female screw portion (not shown) formed in the inkjet head 14. The drive screw 34 rotates to move the inkjet head 14. The guide rail 35 is a guide which is inserted into a through-hole formed in the inkjet head 14 to guide the inkjet head 14 which is moved by the rotation of the drive screw 34 so that the posture of the head does not change.

In addition, the driving support part 36*a* is provided for one side ends of the drive screw 34 and the guide rail 35, and the support part 36*b* is provided for the other side ends thereof. The support parts support the drive screw 34 and the guide rail 35 so that the drive screw 34 can rotate forward and backward, and the guide rail 35 does not move. The driving support part 36*a* is provided with a driving source (not shown) such as a motor for driving the drive screw 34. The driving support part 36*a* and the support part 36*b* are both supported by the above-mentioned plate making apparatus casing (not shown).

The inkjet head 14 is movably supported by the drive screw 34 and the guide rail 35. The forward and backward rotation of the drive screw 34 by the driving support part 36*a* causes the inkjet head 14.to reciprocate (scan) in the Y direction (i.e., main scanning direction) while being guided by the guide rail 35. The head moving mechanism 18 may be provided with a plurality of guide rails, or any other posture maintaining means in order to maintain the posture of the inkjet head 14.

The inkjet head 14 is moved while maintaining a predetermined posture in which a portion of the inkjet head 14 to be caused to eject an ink droplet is opposed to the support 12 by the guide rail 35.

A mechanism for moving the inkjet head 14 is not limited to the head moving mechanism 18 described above, and any one of various known moving mechanisms can be used. For example, the following constitution can be used: the drive screw is a rod-like member such as a guide rail, guide wires are attached to both ends of the inkjet head in the Y direction, and the guide wire on the inkjet head moving direction side is wound, so that the inkjet head is moved along the guide rail. A rack-and-pinion mechanism may also be used. In addition, the inkjet head may be of a self-propelled inkjet head. Further, a linear motor may be used.

The scanning UV irradiation section 16 is disposed to be opposed to the support 12 and to be on the transport downstream side (backward in the sub-scanning (X) direction) of the printing base plate P by a predetermined distance L from the inkjet head 14. The scanning UV irradiation section 16 scans and irradiates the recording surface of the printing base plate P with UV light in the main scanning (Y) direction to cure the UV ink which has been ejected imagewise onto the recording surface of the printing base plate P and of which an image area is formed. In the present invention, the distance between the inkjet head 14 and the scanning UV irradiation section 16 refers to a distance between the position of an ejection nozzle of the inkjet head 14 and the position of a UV lamp 40 of the scanning UV irradiation section 16 (in the case of a nozzle array, a distance between the central position in the sub-scanning direction (X) and the central position of the UV lamp 40 in the sub-scanning direction (X)).

As shown in FIGS. 3A and 3B, the scanning UV irradiation section 16 includes the UV lamp 40 which is stationarily disposed outside the transport path of the printing base plate P in the main scanning direction and emits UV light, a reflector 42 for turning the UV light emitted from the UV lamp 40 into parallel light parallel to the recording surface of the printing base plate P supported on the support 12, a scanning mirror 44 which reflects the parallel UV light produced by the reflector 42 toward the side of the printing base plate P and which is movable in the main scanning direction, and a mirror moving mechanism 46 for causing the scanning mirror 44 to reciprocate (scan) in the main scanning (Y) direction.

The mirror moving mechanism 46 comprises: two transport rollers 48*a* and 48*b* disposed in parallel with each other in the sub-scanning (X) direction on both sides outside the support 12, or on both sides of the transport path of the printing base plate F having the maximum size that can be used, that is, on both outer sides in the main scanning (Y) direction; an endless belt 50 stretched around the two transport rollers 48*a* and 48*b*; and a driving source (e.g., motor) 52 for rotating the transport roller 48*a*. The scanning mirror 44 is attached to a surface inside a belt portion 50*a* of the endless belt 50 (i.e., surface of the belt portion 50*a* on a side of a belt portion 50*b* of the endless belt 50) while being slanted by a predetermined angle, substantially 45° in FIGS. 3A and 3B. The belt portion 50*a* is one of the opposing belt portions 50*a* and 50*b* of the endless belt 50 stretched around the transport rollers 48*a* and 48*b*, and is positioned on the side of the printing base plate P (i.e., support 12). In addition, an irradiation window 54 is formed in the belt portion 50*a* of the endless belt 50 adjacent to a position where the scanning mirror 44 is attached. Irradiation light reflected by the scanning mirror 44 is transmitted through the irradiation window 54. In addition, two mirror surface plates 56*a* and 56*b* whose inner surfaces opposed to each other constitute mirror finished surfaces are disposed on both sides of the endless belt 50 of the mirror moving mechanism 46 of the scanning UV irradiation section 16 in the sub-scanning (X) direction. The inner surfaces opposed to each other of the belt portions 50*a* and 50*b* of the endless belt 50 preferably constitute mirror finished surfaces.

In the scanning UV irradiation section 16, the transport roller 48*a* is rotated by the driving motor 52 of the mirror moving mechanism 46, so that the endless belt 50 stretched around the transport rollers 48*a* and 48*b* is rotated. For example, the scanning mirror 44 attached to the belt portion 50*a* of the endless belt 50 rotating clockwise in FIG. 3A is moved (i.e., caused to scan) over the printing base plate P on the support 12 from the right end to the left end of the printing plate P in FIG. 3A in the direction indicated by the arrow Y (i.e., main scanning direction), so the printing base plate P is scanned from the right end to the left end in FIG. 3A while being irradiated with UV light with a rectangular cross sectional shape reflected by the scanning mirror 44. After that, the transport roller 48*a* is rotated backward, whereby the endless belt 50 is rotated backward in FIG. 3A. The scanning mirror 44 attached to the endless belt 50 rotating counterclockwise in FIG. 3A is moved (caused to scan) over the printing base plate P on the support 12 from the left end to the right end of the printing plate P in FIG. 3A in the direction indicated by the arrow Y. Thus, the printing base plate P is scanned from the left end to the right end in FIG. 3A while being irradiated with the UV light with a rectangular cross sectional shape by the scanning mirror 44.

The UV lamp 40 is used for radiating UV light to the image area formed of the UV ink on the printing base plate P by the inkjet head 14 to cure the UV ink. Examples of the UV lamp 40 include: various lamps (i.e., point light sources) such as an ultra-high pressure mercury lamp and a metal halide lamp; tube bulbs such as an ultraviolet fluorescent tube; and substantially point lamps obtained by using them. Each of those light sources may radiate light including a visible light ray. When photocurable ink (UV ink in this embodiment) is sensitive to light in a visible region, the radiation of light including a visible light ray to the ink can improve the sensitivity of the ink, whereby the UV ink can be suitably cured. In the present invention, if a device cost is not taken into consideration, a UVLED or UVLED array can be used instead of the UV lamp 40. However, the use of the UVLED or UVLED array is not preferable because the use results in an increase in cost.

The reflector 42 contains the UV lamp 40 in itself, and includes an emission port 42*a* with a rectangular cross sectional shape for emitting the UV light emitted from the UV lamp 40 as parallel light with a rectangular cross sectional shape. The inner surface of the reflector 42 is a mirror finished surface. The UV light emitted from the UV lamp 40 is reflected on the inner surface without being absorbed, and is entirely emitted as parallel UV light with a rectangular shape from the emission port 42*a*.

The reflector 42 having the UV lamp 40 in itself is disposed between the opposing belt portions 50*a* and 50*b* of the endless belt 50 and near the transport roller 48*a* with its emission port 42*a* facing toward the side of the transport roller 48*b*. Thus, the parallel UV light with a rectangular cross sectional shape emitted from the emission port 42*a* of the reflector 42 advances through a waveguide 58 between the transport rollers 48*a* and 48*b* with a rectangular cross sectional shape. The waveguide 58 is composed of a space with a substantially rectangular parallelopiped shape formed between the belt portions 50*a* and 50*b* having the opposing inner surfaces which are mirror finished surfaces of the endless belt 50 and between the two mirror surface plates 56*a* and 56*b* having the opposing inner surfaces which are mirror finished surfaces.

The scanning mirror 44 is fixed to a predetermined position of the inner surface of the belt portion 50*a* of the endless belt 50 while being slanted by substantially 45°. The scanning mirror 44 must be fixed to the inner surface of the belt portion 50*a* so that the angle by which the mirror is slanted does not change during the reciprocating movement of the mirror. A method of fixing the scanning mirror 44 to the inner surface of the belt portion 50*a* is not particularly limited as long as the maintenance of the angle can be realized.

The scanning mirror 44 reflects the parallel UV light with a rectangular cross sectional shape which is emitted from the UV lamp 40, is radiated from the emission port 42*a* of the reflector 42, and advances through the waveguide 58 whose four inner peripheral surfaces constitute mirror finished surfaces, toward the irradiation window 54 formed in the belt portion 50*a* of the endless belt 50. The UV light with a rectangular cross sectional shape reflected by the scanning mirror 44 is transmitted through the irradiation window 54 to be radiated onto the printing base plate P placed on the support 12. In this case, the scanning mirror 44 is also caused to reciprocate by the mirror moving mechanism 46 together with the endless belt 50 caused to reciprocate in the direction indicated by the arrow Y (i.e., main scanning direction), so the UV light with a rectangular cross sectional shape reflected by the scanning mirror 44 reciprocates for scanning while being irradiated to the recording surface of the printing base plate P.

While the scanning mirror 44 may be any reflection mirror as long as it can reflect the parallel UV light with a rectangular cross sectional shape, a total reflection mirror capable of reflecting all light beams is preferable. The irradiation window 54 may be a rectangular opening formed in the belt portion 50*a* of the endless belt 50, or may be formed of a rectangular, transparent resin film or transparent member in the belt portion 50*a* of the endless belt 50.

The endless belt 50 of the mirror moving mechanism 46 is not limited as long as its inner surface is a mirror finished surface and the belt has a predetermined strength even after the formation of the irradiation window 54 in part of the belt. The belt is preferably, for example, an endless belt made of stainless steel (i.e., stainless belt).

Each of the transport rollers 48*a* and 48*b* around which the endless belt 50 as described above is stretched preferably has a diameter larger than the height of the reflector 42 having the UV lamp 40 in itself and a length slightly longer than the belt width of the endless belt 50 longer than the longitudinal length of the reflector 42. Each of the transport rollers 48*a* and 48*b* is rotatably supported by the above-mentioned plate making apparatus casing (not shown) through, for example, a bearing.

The driving source 52 is not limited as long as it can rotate the transport roller 48*a* forward and backward. For example, an electric motor can be used as the source. The source may be directly connected to the rotational axis of the transport roller 48*a*, or may be connected to the axis through a transmission system such as a belt transmission using a belt and a pulley, or a gear transmission. The driving source 52 is also supported by the above-mentioned plate making apparatus casing (not shown).

In addition, as described above, the mirror surface plates 56*a* and 56*b* are provided in parallel with each other for both sides of the endless belt 50 of the mirror moving mechanism 46 so that their mirror finished surfaces constitute opposing inner surfaces. In addition, the opposing inner mirror finished surfaces of the plates and the inner mirror finished surfaces of the opposing belt portions 50*a* and 50*b* of the endless belt 50 are used for forming the waveguide 58 with a rectangular cross sectional shape through which the parallel UV light with a rectangular cross sectional shape emitted from the UV lamp 40 and radiated from the emission port 42*a* of the reflector 42 advances. Accordingly, the mirror surface plates 56*a* and 56*b* are not limited as long as their inner surfaces are mirror finished surfaces. Each of the mirror surface plates is desirably a flat plate whose inner surface is a mirror finished surface, the flat plate having a length enough for covering the scanning range (i.e., reciprocating movement range) of the scanning mirror 44 fixed to the endless belt 50, that is, a length covering at least a range from the emission port 42*a* of the reflector 42 to the vicinity of the transport roller 48*b*, or preferably a length covering a range slightly wider than the range, and a width covering a range between the opposing belt portions 50*a* and 50*b* of the endless belt 50, or preferably a range slightly wider than the range.

As described above, the controller 22 controls the operation of each of the inkjet head 14, the scanning UV irradiation section 16, the head moving mechanism 18, and the transport mechanism 20. To be specific, the controller 22 controls: the ejection operation of the UV ink in accordance with image data by the inkjet head 14 for forming an image area on the printing base plate P; scanning and irradiation with the UV light by the scanning UV irradiation section 16 for curing the UV ink of which the image area on the printing base plate P is formed; the reciprocating movement (i.e., main scanning) of the scanning mirror 44 that reflects, in particular, the UV light emitted from the UV lamp 40 and radiated from the emission port 42*a* of the reflector 42 by the mirror moving mechanism 46; the reciprocating movement (i.e., main scanning) of the inkjet head 14 in the main scanning direction by the head moving mechanism 18; and the transport (preferably intermittent transport) of the printing base plate P in the sub-scanning direction by the transport mechanism 20.

The controller 22 preferably controls the entirety of the plate making apparatus 10, or all components (not shown) as well as those described above.

Hereinafter, the action of the inkjet drawing device according to the first aspect of the present invention, and a method of producing a lithographic printing plate to which the inkjet drawing method according to the second aspect of the present invention is applied will be explained by describing the action of the plate making apparatus shown in FIGS. 1 to 3B.

In the plate making apparatus 10 shown in FIGS. 1 to 3B, the printing base plate P is supplied from the not shown automatic plate feeding device to the support 12.

The printing base plate P supplied to the support 12 is transported by the transport mechanism 20 in the sub-scanning direction (i.e., X direction shown in FIG. 1) at a predetermined speed.

The printing base plate P is transported by the transport mechanism 20 to a position opposed to the inkjet head 14. The inkjet head 14 ejects the UV ink onto the surface of the printing base plate P in accordance with an image signal while being moved by the head moving mechanism 18 in the main scanning direction. As a result, an image area is formed of the UV ink on the surface of the printing base plate P.

As a result of the transport of the printing base plate P in the sub-scanning direction by the transport mechanism 20 and the reciprocating movement of the inkjet head 14 in the main scanning direction (i.e., Y direction shown in FIG. 1) by the head moving mechanism 18, the inkjet head 14 scans the entire surface of the printing base plate P, thereby forming the image area of the UV ink at a desired position in the entire surface of the printing base plate P.

The printing base plate P that has passed the position opposed to the inkjet head 14 is thereafter transported to a position opposed to the scanning UV irradiation section 16. As described above, the scanning UV irradiation section 16 causes the scanning mirror 44 that reflects the parallel UV light with a rectangular cross sectional shape emitted from the UV lamp 40 onto the recording surface of the printing base plate P to reciprocate for scanning in the main scanning direction with the aid of the mirror moving mechanism 46, so that the UV light reflected by the scanning mirror 44 is irradiated to the UV ink of the image area formed on the recording surface of the printing base plate F while reciprocating for scanning. That is, the scanning mirror 44 that reflects the UV light emitted from the UV lamp 40 is moved in the main scanning direction, so that the serial scanning of the scanning mirror 44 is performed on the printing base plate P, whereby the entire surface of the printing base plate can be irradiated with the UV light reflected by the scanning mirror 44 as in the case of the inkjet head 14 described above.

The UV ink formed into the image area on the surface (i.e., recording surface) of the printing base plate P is cured by being irradiated with the UV light with a rectangular cross sectional shape emitted from the UV lamp 40 and reflected by the scanning mirror 44.

The printing base plate P on which the image area has been cured with the UV light emitted from the UV lamp 40 is further transported in the sub-scanning direction (i.e., X direction shown in FIG. 1) to be transferred to the next step or to be discharged as a complete printing plate from the plate making apparatus 10.

In the present invention, the inkjet head 14 and the scanning UV irradiation section 16, specifically, the center of the inkjet head 14 in the X direction (i.e., center of an ejection nozzle array in the X direction) and the center of the scanning UV irradiation section 16 in the X direction (i.e., center of the UV lamp 40 in the X direction) are set to be distant from each other by the distance L or longer. The distance L is a distance in which the influences of heat by the UV lamp 40, specifically, the influences of heat radiated from the UV lamp 40 itself and of a heat ray (i.e., thermal component) in the UV light emitted from the UV lamp 40 to be radiated to the printing base plate P on the printing base plate P do not reach the drawing by the inkjet head 14. The distance is determined on the basis of various conditions including: the speed of the drawing by the inkjet head 14; the kinds or structures of the inkjet head 14 and the UV lamp 40; the speed at which the printing base plate P is transported in the sub-scanning direction; a material or quality of material of the printing base plate P; and the quantity of the UV light radiated from the UV lamp 40 to the printing base plate P.

Setting the distance between the inkjet head 14 and the scanning UV irradiation section 16 (i.e., UV lamp 40) to be equal to or longer than L can prevent the distortion of the printing base plate P from occurring at a position where an image is recorded by the inkjet head 14 (i.e., position on which a UV ink droplet impinges) owing to thermal expansion caused by the heating of the printing base plate P with UV light having a thermal component and radiated from the UV lamp 40 or with heat radiated from the lamp. Therefore, the displacement of the position where an image is recorded by the inkjet head 14 on the printing base plate P can be prevented.

With the procedure, in a printing apparatus to which the present invention is applied, a printing plate on which a high-quality and high-definition image having high accuracy of an image recording position is formed can be produced; even when multicolor printing is performed by using multiple printing plates, the printing causes no color shift, and can show high accuracy and high quality.

The distance L (cm) is preferably 0.5×dt or longer, or more preferably 1.0×dt or longer where dt represents a temperature difference (° C.) between the maximum temperature of the printing base plate at the time of irradiation with the UV light, in other words, the temperature of the printing base plate P at the center point of a region irradiated with the UV light, and room temperature.

Setting the distance L to be equal to or longer than 0.5×dt can result in the formation of an image having additionally high accuracy of an image recording position, additionally high quality, and an additionally high definition. Further, setting the distance to be equal to or longer than 1.0×dt can additionally suitably exert the above-mentioned effects.

There is no particular need to define an upper limit value for the distance in order to obtain those effects. However, when the distance L becomes large, there arise problems in that a width in which ink on the printing base plate P blurs expands, and that the size of the apparatus increases. Accordingly, the distance L is preferably set to be 2.5×dt or shorter. Such setting can prevent the expansion of the width in which the ink on the printing base plate P blurs, and can reduce the size of the apparatus.

Irrespective of the speed at which recording is performed by the inkjet head 14 on the printing base plate P, the moving (scanning) speed of the scanning mirror 44 is adjusted by the mirror moving mechanism 46, and hence the scanning speed of the scanning UV light reflected by the scanning mirror 44 is adjusted, whereby the light irradiation time at each position of the printing base plate P can be adjusted.

With the procedure, the quantity of the UV light with which the UV ink of the image area formed by the inkjet head 14 is irradiated (i.e., irradiation energy) can be adjusted, for example, can be kept always constant. As a result, the UV ink of the image area can be properly cured.

In addition, the quantity of the UV light with which each position of the printing base plate P is irradiated (i.e., irradiation energy=quantity of light per unit time×light irradiation time) can be adjusted without adjusting the quantity of the UV light emitted from the UV lamp 40.

Further, even when the quantity of the light changes over time in association with the use of the UV lamp 40, the printing base plate P can be irradiated with a constant quantity of the UV light by adjusting the moving speed of the scanning mirror 44, that is, the scanning speed of the scanning UV light in accordance with the quantity of the light emitted from the UV lamp 40.

The ratio at which the scanning speed of the UV light is changed may be adjusted in accordance with, for example, a material for the printing base plate P, a material for the UV ink, and an image forming method.

In addition, even when the quantity of light of the UV lamp 40 changes over time, the ink can be cured with the constant quantity of light by changing the scanning speed of the UV light. To be specific, when the quantity of light to be applied from the UV lamp 40 reduces in half, the UV ink on the printing base plate can be cured with the same quantity of light to be applied as that at the time when the lamp is first used by reducing the scanning speed of the UV light in half.

Each component of the plate making apparatus 10 of one embodiment of the present invention has been described above in detail. However, the present invention is not limited to this.

For example, in the above-mentioned embodiment, the inkjet head is a serial head to be moved in the main scanning direction because such head has, for example, an effect of reducing the cost of the apparatus. However, the present invention is not limited to this, and the inkjet head may be an inkjet head with a shape longer than the width of the printing base plate in the main scanning direction. In other words, the inkjet head may be a line head.

A plate making apparatus to which the present invention is applied is basically constituted as described above.

In the plate making apparatus 10 of the above-mentioned embodiment, the inkjet head 14 and the scanning UV irradiation section 16 are disposed so as to be distant from each other by a predetermined distance equal to or longer than the distance L. However, like a plate making apparatus 60 shown in FIG. 4, the following constitution may be adopted: the scanning UV irradiation section 16 is made movable in the sub-scanning direction relative to the inkjet head 14 so that the distance L is adjustable. In addition, in the present invention, like the plate making apparatus 60 shown in FIG. 4, a plate surface protective solution (hereinafter referred to as "gum solution") may be applied for protecting the image area formed by curing the UV ink ejected imagewise onto the printing base plate P by the inkjet head 14 with the scanning UV light from the scanning UV irradiation section 16.

Figure 4:
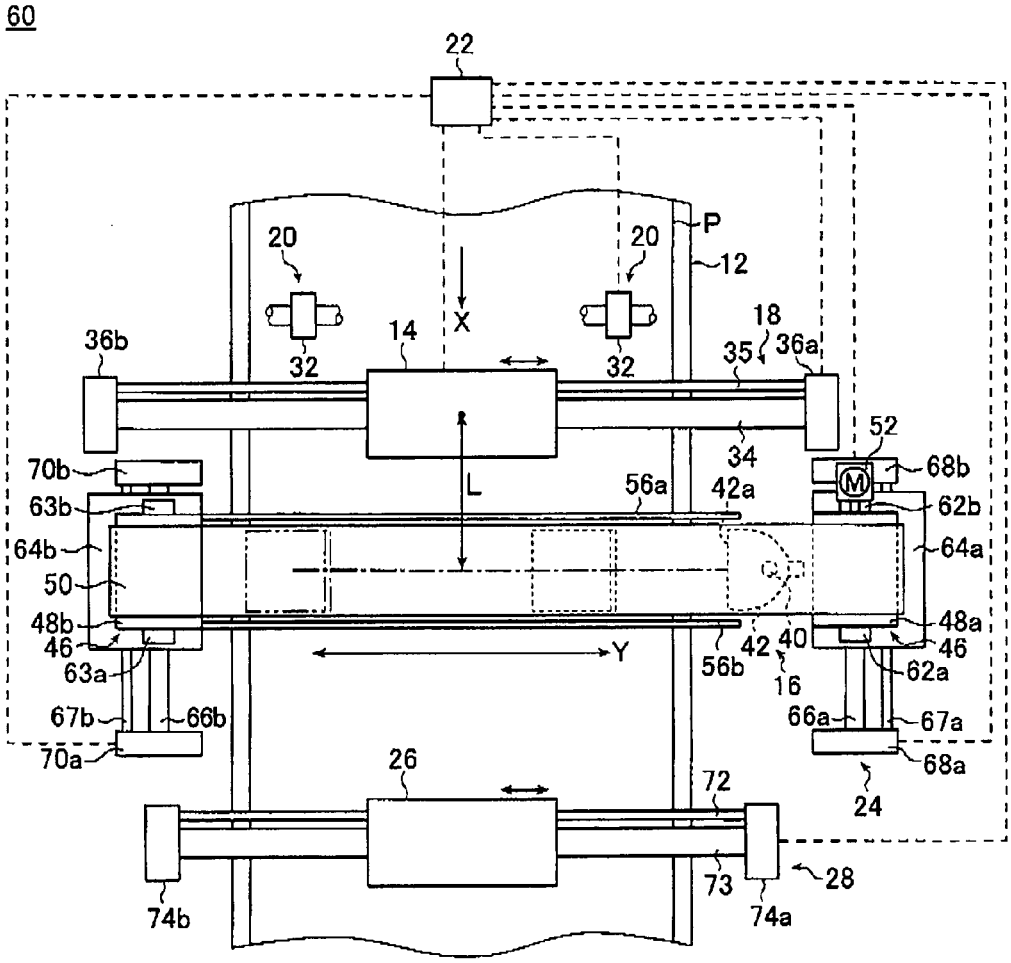
FIG. 4 is a schematic top view showing a schematic constitution of another embodiment of the plate making apparatus to which the inkjet drawing device according to the present invention is applied.
Figure 5:
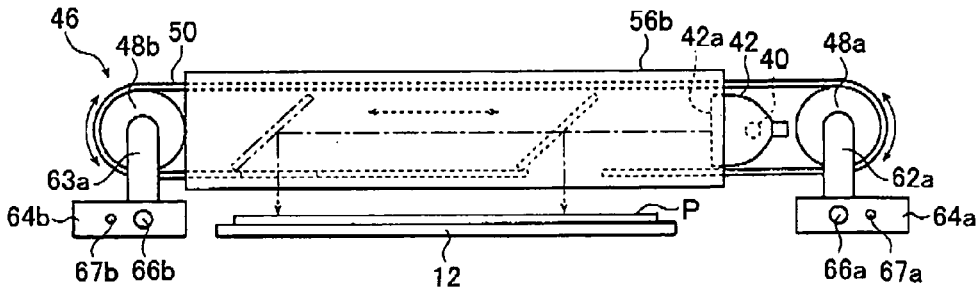
FIG. 5 is a schematic cross sectional view of the scanning UV irradiation section and irradiation section moving mechanism of the plate making apparatus shown in FIG. 4.

FIG. 4 is a schematic top view showing the schematic constitution of another embodiment of the plate making apparatus to which the inkjet drawing device according to the present invention is applied. FIG. 5 is a schematic front view of the scanning UV (i.e., ultraviolet light) irradiation section and irradiation section moving mechanism of the plate making apparatus shown in FIG. 4.

The plate making apparatus 60 shown in FIG. 4 has the same constitution as that of the plate making apparatus 10 shown in FIGS. 1 to 3B except for a support part for the scanning UV irradiation section 16, an irradiation section moving mechanism 24, a gum solution ejection head 26, and a head moving mechanism 28. The same components are provided with the same reference numerals, and the detailed descriptions thereof are omitted. The irradiation section moving mechanism 24, the gum solution ejection head 26, and the head moving mechanism 28 will be mainly described.

The plate making apparatus 60 shown in FIG. 4 includes: the support 12; the inkjet head 14; the scanning UV irradiation section 16; the head moving mechanism 18; the transport mechanism 20; the controller 22; the irradiation section moving mechanism 24 for causing the scanning UV irradiation section 16 to reciprocate in the sub-scanning direction (i.e., X direction) relative to the inkjet head 14; the gum solution ejection head 26 for ejecting a gum solution onto the printing base plate P on which the image area has been formed by performing drawing imagewise with the UV ink by the inkjet head 14 and curing the ink with the scanning UV light from the scanning UV irradiation section 16; and the head moving mechanism 28 for moving the gum solution ejection head in the main scanning direction (i.e., Y direction).

In the plate making apparatus 60 shown in FIG. 4, the controller 22 controls the operation of each of the irradiation section moving mechanism 24, the gum solution ejection head 26, and the head moving mechanism 28 in addition to the operation of each of the inkjet head 14, the scanning UV irradiation section 16, the head moving mechanism 18, and the transport mechanism 20.

As shown in FIGS. 4 and 5, the scanning UV irradiation section 16 further includes: support legs 62*a* and 62*b* for rotatably supporting the rotational axis of the transport roller 48*a* from both sides of the axis; support legs 63*a* and 63*b* for rotatably supporting the-rotational axis of the transport roller 48*b* from both sides of the axis; a support member 64*a* for supporting the support legs 62*a* and 62*b*, and the driving source 52; and a support member 64*b* for supporting the support legs 63*a* and 63*b*. Those components constitute the portion for supporting the scanning UV irradiation section 16.

The irradiation section moving mechanism 24 causes the scanning UV irradiation section 16 to reciprocate (scan) in the sub-scanning direction (i.e., X direction), that is, moves the scanning UV irradiation section 16 on a plane distant from the surface of the support 12 by a predetermined distance. The mechanism 24 includes drive screws 66*a* and 66*b*, guide rails 67*a* and 67*b*, driving support parts 68*a* and 70*a*, and support parts 68*b* and 70*b*.

Next, each of the drive screws 66*a* and 66*b*, and the guide rails 67*a* and 67*b* is disposed so as to be parallel to the sub-scanning direction.

In addition, each of the drive screws 66*a* and 66*b* is composed of, for example, a ball screw (not shown) having a male screw portion that is screwed into a female screw portion (not shown) formed in each of the support members 64*a* and 64*b*. The drive screws 66*a* and 66*b* rotate to move the support members 64*a* and 64*b*, respectively. The guide rails 67*a* and 67*b* are inserted into through-holes formed in the support members 64*a* and 64*b*, respectively, so as to guide the support members 64*a* and 64*b* moved by the rotation of the drive screws 66*a* and 66*b* without changing the posture of each of the members.

The driving support part 68*a* is provided for one side ends of the drive screw 66*a* and the guide rail 67*a*, and the support part 68*b* is provided for the other side ends thereof. The support parts support the drive screw 66*a* so that the drive screw 66*a* can rotate forward and backward, and support the guide rail 67*a* as well. In addition, the driving support part 70*a* is provided for one side ends of the drive screw 66*b* and the guide rail 67*b*, and the support part 70*b* is provided for the other side ends thereof. The support parts support the drive screw 66*b* so that the drive screw 66*b* can rotate forward and backward, and support the guide rail 67*b* as well.

The driving support parts 68*a* and 70*a* are each provided with a driving source (not shown) such as a motor for driving the drive screws 66*a* and 66*b*. All of the driving support parts 68*a* and 70*a*, and the support parts 68*b* and 70*b* are supported by the above-mentioned plate making apparatus casing (not shown).

The driving support part 68*a* and the support part 68*b* rotate the drive screw 66*a*, and the driving support part 70*a* and the support part 70*b* rotate the drive screw 66*b*, whereby the support members 64*a* and 64*b* are moved in the sub-scanning direction (i.e., X direction) while being guided by the guide rails 67*a* and 67*b*. The support members 64*a* and 64*b* are moved in the sub-scanning direction, whereby the scanning UV irradiation section 16 supported by: the support legs 62*a* and 62*b* supported by the support member 64*a*; and the support legs 63*a* and 63*b* supported by the support member 64*b* is also moved in the sub-scanning direction. Thus, the scanning UV irradiation section 16 is made movable in the sub-scanning direction, and the UV lamp 40, the endless belt 50, and the scanning mirror 44 are also made movable in the sub-scanning direction, whereby the scanning UV light emitted from the UV lamp 40 and reflected by the scanning mirror 44 is also made movable in the sub-scanning direction.

In this case, the driving support parts 68*a* and 70*a* cause the support members 64*a* and 64*b* to move in synchronization with each other in order that the positions of the support members 64*a* and 64*b* in the sub-scanning direction may be identical to each other, that is, the scanning UV irradiation section 16 may not slant toward the sub-scanning direction.

The irradiation section moving mechanism 24 may be provided with a plurality of guide rails, or any other posture maintaining means in order that the posture of the scanning UV irradiation section 16 may be maintained. The scanning UV irradiation section 16 is moved by the drive screws 66*a* and 66*b*, and the guide rails 67*a* and 67*b* while maintaining a predetermined posture in which the scanning UV irradiation section 16 is opposed to the support 12.

A mechanism for moving the scanning UV irradiation section 16 is not limited to the irradiation section moving mechanism 24 described above, and any one of various known movement mechanisms can be used. For example, the following constitution may be used: one of the drive screws 66*a* and 66*b* is a guide rail, the driving support part of the one drive screw is used as a support part, and the support members 64*a* and 64*b* are moved only by the one drive screw. Alternatively, the following constitution may be used: the support members 64*a* and 64*b* are coupled with each other to provide an integrated support member, a region to be scanned with UV light by the scanning mirror 44 of the scanning UV irradiation section 16 is provided with an opening, and the scanning UV irradiation section is moved above the printing base plate P in the sub-scanning direction.

Alternatively, the following constitution can also be used: the drive screws are each a rod-like member such as a guide rail, guide wires are attached to both ends of the support members 64*a* and 64*b* in the Y direction, and the guide wire on the scanning UV irradiation section moving side is wound, so that the scanning UV irradiation section is moved along the guide rail. A rack-and-pinion mechanism may also be used. In addition, the scanning UV irradiation section may be of a self-propelled section. Further, a linear motor may be used.

Alternatively, the following constitution may be used: each of the transport rollers 48*a* and 48*b* of the scanning UV irradiation section 16 is a cylindrical member to serve as an external cylinder, the center of an internal cylinder for rotatably supporting the external cylinder is provided with a female screw into which the male screw of the drive screw is screwed, and the drive screw is rotated to move the external cylinder in synchronization with the internal cylinder in the sub-scanning direction, and, in the meantime, the external cylinder is rotated by the driving source 52 with respect to the internal cylinder, so that the transport rollers 48*a* and 48*b* are rotated, and the endless belt 50 is rotated.

In this embodiment, the controller 22 preferably controls the head moving mechanism 18 and the irradiation section moving mechanism 24 in order that the inkjet head 14 and the scanning UV irradiation section 16 (i.e., UV lamp 40) may be distant from each other by the distance L or longer, but the adjustment of the distance L by the irradiation section moving mechanism 24 may be manually performed.

Thus, in this embodiment, the UV light emitted from the UV lamp 40 can be moved in each of both the main scanning direction and the sub-scanning direction. The UV light emitted from the UV lamp 40 is moved by the scanning UV irradiation section 16 and the irradiation section moving mechanism 24 in the sub-scanning direction in addition to the main scanning direction as described above, whereby the distance L can be adjusted in accordance with, for example, a relative speed between the printing base plate P and the scanning UV irradiation section 16 (i.e., UV light emitted from the UV lamp 40) in the sub-scanning direction, the above-mentioned speed of the drawing by the inkjet head 14, the kinds or structures of the inkjet head 14 and the UV lamp 40, the speed at which the printing base plate P is transported in the sub-scanning direction, a material or quality of material of the printing base plate P, and the quantity of the UV light applied from the UV lamp 40 to the printing base plate P. As a result, the distance L between the inkjet head and the scanning UV irradiation section 16 (i.e., scanning UV light) can be adjusted by the controller 22 under various conditions to fall within a suitable range.

In addition, the scanning UV irradiation section 16 is made movable in the sub-scanning direction, i.e., the UV lamp 40 is movable in the sub-scanning direction, whereby it is possible to adjust a relative speed between the transport of the printing base plate P by the transport mechanism 20 and the movement of the UV lamp 40, i.e., the scanning UV light in the sub-scanning direction. In other words, the relative speed between the inkjet head 14 and the printing base plate P in the sub-scanning direction and the relative speed between the scanning UV light (i.e., UV lamp 40) and the printing base plate P in the sub-scanning direction can be made different from each other.

With the procedure, even when the speed of the drawing (i.e., recording) by the inkjet head 14 and the optimum moving speed of the scanning UV light (i.e., UV lamp 40) are different from each other, the light irradiation time at each position of the printing base plate can be adjusted by moving the irradiation position of the UV light in the sub-scanning direction while moving the irradiation position of the UV light in the main scanning direction. In other words, the speed of the drawing by the inkjet head 14 on the printing base plate P and the moving speed of the scanning UV light relative to the printing base plate P can be made different from each other. With the procedure, the drawing (i.e., image recording) by the inkjet head 14 and the curing of the UV ink with the scanning UV light can be suitably performed. In addition, the quantity of the scanning UV light at each position of the printing base plate P can be adjusted without adjusting the quantity of the UV light applied from the UV lamp 40. Further, even when the light quantity of the UV lamp 40 changes over time in association with the use of the lamp, the UV lamp 40 can radiate a constant quantity of light to the printing base plate P by adjusting the moving speed of the irradiation position of the UV light in accordance with the light quantity of the UV lamp 40.

The moving speed of the scanning UV light emitted from the UV lamp 40 is preferably changed in multiple stages or continuously in each of the main scanning direction and the sub-scanning direction.

The light quantity at each position of the printing base plate P can be adjusted by changing the moving speed of the scanning UV light in multiple stages or continuously. The adjustment of the moving speed of the scanning UV light, that is, the scanning speed of the UV light in accordance with the area ratio or image density of an image area, the rate of the adjustment (i.e., rate of the speed change), and the optimization and improvement in efficiency of the curing of the UV ink on the printing base plate P by such adjustment may be performed in the method similar to those in the above-mentioned case of the moving (scanning) speed of the scanning UV light in the main-scanning direction.

The gum solution ejection head 26 is used for ejecting a plate surface protective solution (hereinafter simply referred to as "gum solution") on the printing plate P having an image area thereon formed by performing drawing imagewise thereon with the UV ink by the inkjet head 14 and curing the UV ink with the scanning UV light from the scanning UV irradiation section 16, thereby protecting the plate surface on which the image area is formed. The gum solution ejection head 26 is disposed on the downstream side of the scanning UV irradiation section 16 in the sub-scanning transport direction of the printing base plate P so as to be opposed to the support 12.

The gum solution ejection head 26 ejects the gum solution onto the surface of the printing base plate P having the image area thereon which is formed by curing the UV ink ejected from the inkjet head 14 by the UV lamp 40, or preferably ejects the gum solution onto the surface of the printing base plate P in accordance with a predetermined gum solution ejection signal, to form a gum solution film on the non-image area of the printing base plate P.

The term "gum solution ejection signal" as used herein refers to an ejection signal for causing a droplet to be ejected on the basis of, for example, an image signal so that the gum solution is selectively applied to an area serving as a non-image area. When the gum solution is applied to a non-image area as in this embodiment, the inversion signal of the ink ejection signal (which may hereinafter be simply referred to as "ejection signal") for controlling the ejection of an ink droplet by the inkjet head 14 can be used as the gum solution ejection signal.

An inkjet head according to any one of various modes can be used as the gum solution ejection head 26 as in the case of the inkjet head 14. It is particularly preferable to use a drop-on-demand inkjet head employing a piezoelectric mode or a thermal mode as the gum solution ejection head 26. An inkjet head having a resolution lower than that of the inkjet head 14 can be used as the gum solution ejection head 26.

The head moving mechanism 28 is used for moving the gum solution ejection head 26 in the main scanning direction (i.e., X direction), and includes a drive screw 72, a guide rail 73, a driving support part 74*a*, and a support part 74*b*. The mechanism has basically the same constitution as that of the head moving mechanism 18.

Each of the drive screw 72 and the guide rail 73 is disposed so as to be parallel to the main scanning direction (i.e., Y direction shown in FIG. 1) perpendicular to the direction in which the printing base plate P is transported (i.e., X direction shown in FIG. 1), and to extend across the left end and right end of the printing base plate P having the maximum size that can be used.

The drive screw 72 is composed of, for example, a ball screw (not shown) having a male screw portion that is screwed into a female screw portion (not shown) formed in the gum solution ejection head 26. The drive screw rotates to move the gum solution ejection head 26 in the main scanning direction. The guide rail 73 is a guide which is inserted into a through-hole formed in the gum solution ejection head 26 to guide the gum solution ejection head 26 moved by the rotation of the drive screw 72 so that the posture of the head does not change.

In addition, the driving support part 74*a* is provided for one side ends of the drive screw 72 and the guide rail 73, and the support part 74*b* is provided for the other side ends thereof. The support parts support the drive screw 72 and the guide rail 73 so that the drive screw 72 can rotate forward and backward and the guide rail 73 does not move. The driving support part 74*a* includes a driving source (not shown) such as a motor for driving the drive screw 72. The driving support part 74*a* and the support part 74*b* are both supported by the above-mentioned plate making apparatus casing (not shown).

The gum solution ejection head 26 is movably supported by the drive screw 72 and the guide rail 73. The forward and backward rotation of the drive screw 72 by the driving support part 74*a* causes the gum solution ejection head to reciprocate (scan) in the Y direction (i.e., main scanning direction) while being guided by the guide rail 73. The head moving mechanism 28 may include a plurality of guide rails, or any other posture maintaining means in order to maintain the posture of the gum solution ejection head 26. The gum solution ejection head 26 is moved while maintaining a predetermined posture in which a portion to be caused to eject the gum solution is opposed to the support 12 by the guide rail 73.

A mechanism for moving the gum solution ejection head 26 is not limited to the head moving mechanism 28 described above, and any one of various known movement mechanisms can be used as in the case of the head moving mechanism 18. For example, the following constitution can be used: the drive screw is a rod-like member such as a guide rail, guide wires are attached to both ends of the gum solution ejection head in the Y direction, and the guide wire on the gum solution ejection head moving side is wound, so that the gum solution ejection head is moved along the guide rail. A rack-and-pinion mechanism may also be used. In addition, the gum solution ejection head may be of a self-propelled head. Further, a linear motor may be used.

The gum solution ejection head 26 preferably ejects the gum solution in accordance with a gum solution ejection signal while being moved in the main scanning direction by the head moving mechanism 28, to form a gum solution film on the printing base plate P. The gum solution film can be selectively formed on a required portion, in particular, a non-image area in accordance with the position of the image area of the printing base plate P by causing the gum solution ejection head 26 to eject the gum solution in accordance with the gum solution ejection signal as described above. Such procedure enables the gum solution to be efficiently used. When the gum solution is ejected only onto the non-image area, and the gum solution film is formed only on the non-image area as described above, the gum solution can be used with reduced waste and improved efficiency, whereby the consumption of the gum solution can be additionally reduced.

In the above-mentioned embodiment, the gum solution ejection head is a serial head that ejects the gum solution while being moved in the main scanning direction (i.e., Y direction shown in the figure). However, the present invention is not limited to this, and the gum solution ejection head may be provided for the entire region of the printing base plate in the main scanning direction. In other words, the gum solution ejection head may be a line head longer than the length of the base printing plate in the main scanning direction.

In addition, a gum solution ejection head is preferably used as in the case of this embodiment partly because the gum solution can be efficiently used as described above. However, the present invention is not limited to this, and the gum solution may be applied to the entire surface of the printing base plate by a gum solution application mechanism according to a roll coater mode or a spray mode.

In addition, a heating device for drying the gum solution film applied to the printing base plate may be provided on the downstream side of the gum solution ejection head in the sub-scanning direction of the printing base plate. Alternatively, the gum solution film may be dried with waste heat generated by the application of UV light.

In addition, in each of the above-mentioned embodiments, the printing base plate P is transported by the transport mechanism 20 in the sub-scanning direction. However, the present invention is not limited to this. The following constitution may be adopted: the inkjet head, and the scanning UV irradiation section comprising the UV lamp are integrated to be moved in the sub-scanning direction by a common movement mechanism.

Figure 6A:
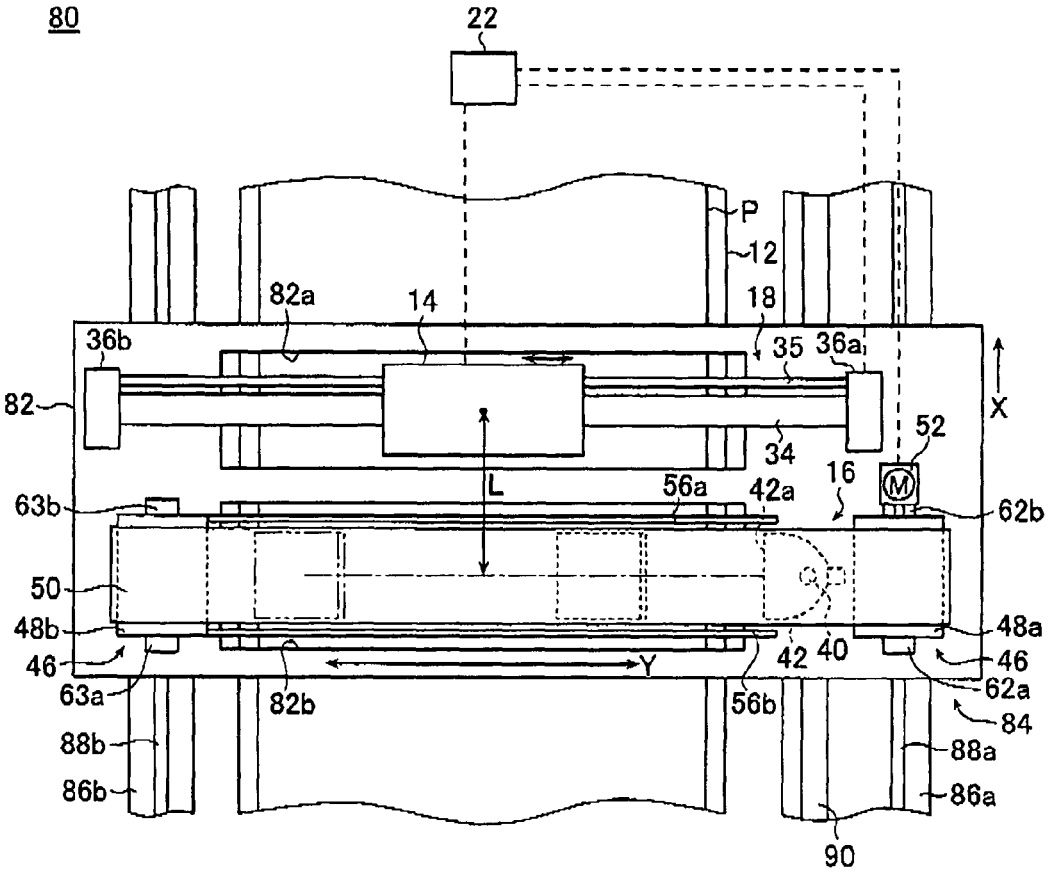
FIG. 6A is a schematic top view showing the schematic constitution of another embodiment of the plate making apparatus to which the inkjet drawing device according to the present invention is applied.
Figure 6B:
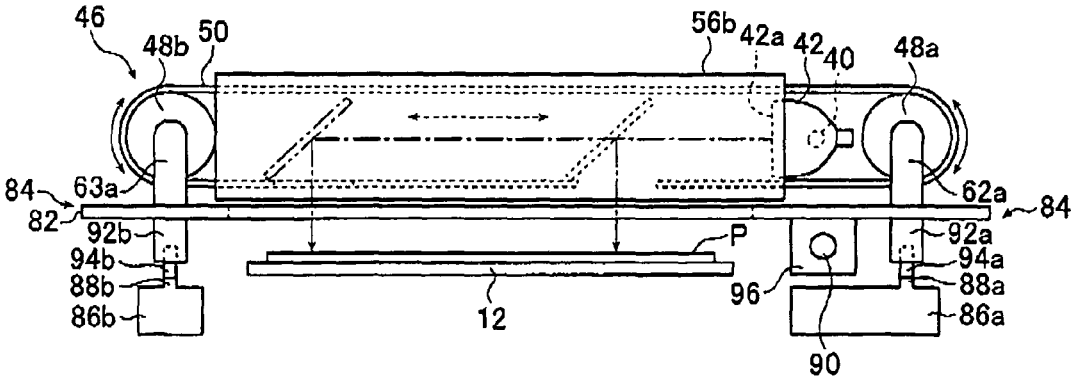
FIG. 6B is a schematic cross sectional view showing the schematic constitution of the plate making apparatus shown in FIG. 6A.

FIG. 6A is a schematic top view showing the schematic constitution of another embodiment of the plate making apparatus to which the inkjet drawing device of the present invention is applied, and FIG. 6B is a schematic cross sectional view showing the schematic constitution of the plate making apparatus shown in FIG. 6A.

A plate making apparatus 80 shown in FIGS. 6A and 6B has the same constitution as that of the plate making device 10 shown in FIGS. 1 to 3B except that the apparatus 80 includes a scanning board 82 on which the inkjet head 14 and the scanning UV irradiation section 16 are mounted, and a transport mechanism 84 for the scanning board 82 instead of the transport mechanism 20 for transporting the printing base plate P in the sub-scanning direction. The same components are provided with the same reference numerals, and the detailed descriptions of the same components are omitted. The scanning board 82 and the transport mechanism 84 will be mainly described.

The plate making apparatus 80 shown in FIGS. 6A and 6B includes: the support 12; the inkjet head 14; the scanning UV irradiation section 16; the head moving mechanism 18; the controller 22; the scanning board 82 on which the inkjet head 14 and the scanning UV irradiation section 16 are integrally mounted; and the transport mechanism 84 for moving the scanning board 82 in the sub-scanning direction (i.e., X direction shown in FIGS. 6A and 6B).

In the plate making apparatus 80 shown in FIGS. 6A and 6B, the controller 22 controls the operation of each of the inkjet head 14, the scanning UV irradiation section 16, the head moving mechanism 18, and the transport mechanism 84.

The scanning board 82 is disposed so as to be opposed to the support 12, and is moved in the sub-scanning direction by the transport mechanism 84. The inkjet head 14, the head moving mechanism 18, and the scanning UV irradiation section 16 comprising the UV lamp 40 are mounted on the scanning board 82. In this case as well, the distance between the inkjet head 14 and the scanning UV irradiation section 16 (i.e., UV lamp 40) is adjusted to be equal to or longer than the distance L.

The driving support part 36*a* and support part 36*b* of the head moving mechanism 18 are attached to the scanning board 82. In addition, the rotational axis of the transport roller 48*a* of the scanning UV irradiation section 16 is rotatably supported by the support legs 62*a* and 62*b* provided on the scanning board 82 from both sides of the axis, and the rotational axis of the transport roller 48*b* of the scanning UV irradiation section 16 is rotatably supported by the support legs 63*a* and 63*b* provided on the scanning board 82 from both sides of the axis. The same support legs as those used in the plate making apparatus 60 shown in FIG. 4 can be used as the support legs 62*a*, 62*b*, 63*a*, and 63*b*.

The inkjet head 14, the head moving mechanism 18, and the scanning UV irradiation section 16 operate in the same manner as the inkjet head 14, head moving mechanism 18, and scanning UV irradiation section 16 of the plate making apparatus 10 shown in FIG. 1, respectively, except that they are mounted on the scanning board 82, and are transported together with the scanning board 82 by the transport mechanism 84 in the sub-scanning direction at a predetermined sub-scanning speed on the printing base plate P fixed to the support 12. In other words, on the scanning board 82 transported in the sub-scanning direction, the inkjet head 14 is moved by the head moving mechanism 18 in the main scanning direction, and the scanning mirror 44 that reflects the UV light emitted from the UV lamp 40 of the scanning UV irradiation section 16 towards the printing base plate P is moved by the mirror moving mechanism 46 in the main scanning direction.

For this purpose, the scanning board 82 is formed with an opening 82*a* in the moving (scanning) region of the inkjet head 14 in the main scanning direction and with an opening 82*b* in the moving (scanning) region of the scanning mirror 44 of the scanning UV irradiation section 16 in the main scanning direction, that is, the main scanning region of the UV light.

The transport mechanism 84 includes: bases 86*a* and 86*b* disposed on both sides outside the support 12 to be parallel to each other in the sub-scanning direction; guide rails 88*a* and 88*b* laid on the bases 86*a* and 86*b* to be parallel to each other in the sub-scanning direction; a drive screw 90 disposed near the guide rail 88*a* to be parallel to the rail 88*a*; wheels 94*a* and 94*b* rotatably supported by support legs 92*a* and 92*b* provided for the back surface side of the scanning board 82 to be opposed to the guide rails 88*a* and 88*b*, respectively; and a travelling nut 96 in which a female screw into which a male screw formed in the drive screw 90 is screwed is formed and which is fixed to the back surface side of the scanning board 82.

Each of the guide rails 88*a* and 88*b*, and the drive screw 90 desirably has a length equal to or longer than the maximum length of the printing base plate P to be used in the sub-scanning direction. The drive screw 90 has both ends rotatably supported by two support legs (not shown), and is rotated by a not shown driving source (e.g., motor). Those support legs are fixed to the base 86*a* or to a not shown plate making apparatus main body. In addition, the number of pairs of the support leg 92*a* and the wheel 94*a* provided for the back surface side of the scanning board 82 along the sub-scanning direction is preferably two or more, and the number of pairs of the support leg 92*b* and the wheel 94*b* provided for the back surface side of the scanning board 82 along the sub-scanning direction is preferably two or more.

In the transport mechanism 84, the wheel 94*a* of the support leg 92*a*, and the wheel 94*b* of the support leg 92*b*, of the scanning board 82 on which the inkjet head 14, the head moving mechanism 18, and the scanning UV irradiation section 16 are mounted on the guide rails 88*a* and 88*b* on the bases 86*a* and 86*b*, and then the drive screw 90 is rotated, so that the travelling nut 96 is moved in the sub-scanning transport direction. As a result, the scanning board 82 can be moved (i.e., transported) in the sub-scanning transport direction while maintaining its proper posture.

Thus, in the plate making apparatus 80, the scanning board 82 on which the inkjet head 14 and the scanning UV irradiation section 16 are mounted is moved in the sub-scanning direction (i.e., X direction) relative to the printing base plate P fixed on the support 12, and, in the meantime, the inkjet head 14 and the scanning mirror 44 of the scanning UV irradiation section 16 (i.e., UV light) are moved in the main scanning direction (i.e., Y direction), whereby an image area is formed on the entire region of the printing base plate P. Further, the image area formed on the printing base plate P is irradiated with the UV light, whereby the UV ink can be cured.

A printing plate can be produced by performing drawing and ink curing while moving the inkjet head and the scanning UV irradiation section 16 integrally in the sub-scanning direction as described above.

As described above, the controller 22 controls the operation of each of the inkjet head 14, the scanning UV irradiation section 16, the head moving mechanism 18, and the transport mechanism 84. To be specific, the controller 22 controls: a drawing operation by the inkjet head 14 for forming an image area on the printing base plate P; scanning and irradiation with the UV light reflected from the scanning mirror 44 by the mirror moving mechanism 46 of the scanning UV irradiation section 16; the main scanning of the inkjet head 14 by the head moving mechanism 18; and the transport (preferably intermittent transport) of the scanning board 82 in the sub-scanning direction by the transport mechanism 84.

In the example shown in FIGS. 6A and 6D, only the inkjet head 14, the head moving mechanism 18, and the scanning UV irradiation section 16 including the UV lamp 40 are mounted on the scanning board 82. However, the present invention is not limited to this. In addition to those components, the irradiation section moving mechanism 24 of the scanning UV irradiation section 16, and/or the gum solution ejection head 26 and the head moving mechanism 28 constituting the plate making apparatus 60 shown in FIG. 4, may be mounted on the scanning board 82.

With such constitution, the distance L between the inkjet head 14 and the scanning UV irradiation section 16 can be adjusted by causing the irradiation section moving mechanism 24 to move the scanning UV irradiation section 16 mounted on the scanning board 82 in the sub-scanning direction relative to the inkjet head 14.

In addition, the distance L can be easily adjusted by: causing the transport mechanism 84 to move the inkjet head 14 and the scanning UV irradiation section 16 integrally in the sub-scanning direction relative to the printing base plate P; and performing the adjustment of the distance L through the movement of the scanning UV irradiation section 16 by the irradiation section moving mechanism 24 in the sub-scanning direction.

Further, by integrating the gum solution ejection head 26 and the head moving mechanism 28 in addition to the inkjet head 14 and the scanning UV irradiation section 16, an image area can be properly formed on the printing base plate P. In addition, a gum solution for protecting a plate surface can be applied onto the printing base plate or printing plate on which the image area has been properly formed, or particularly preferably applied selectively onto a non-image area, and hence a gum solution film can be formed.

Hereinafter, an example of the inkjet head 14 that can be suitably used in the inkjet drawing-device of the present invention and the plate making apparatus to which the inkjet drawing device is applied will be described in detail with reference to FIGS. 7 and 8.

Figure 7:
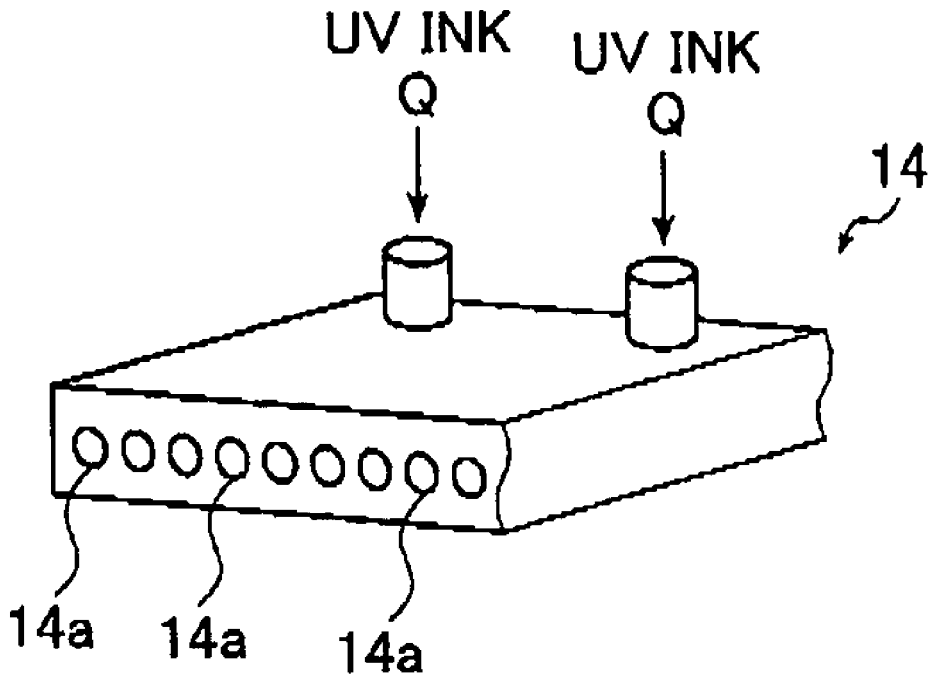
FIG. 7 is a perspective view showing a schematic constitution of the external appearance of an embodiment of an inkjet head for use in the plate making apparatus shown in FIG. 1.
Figure 8:
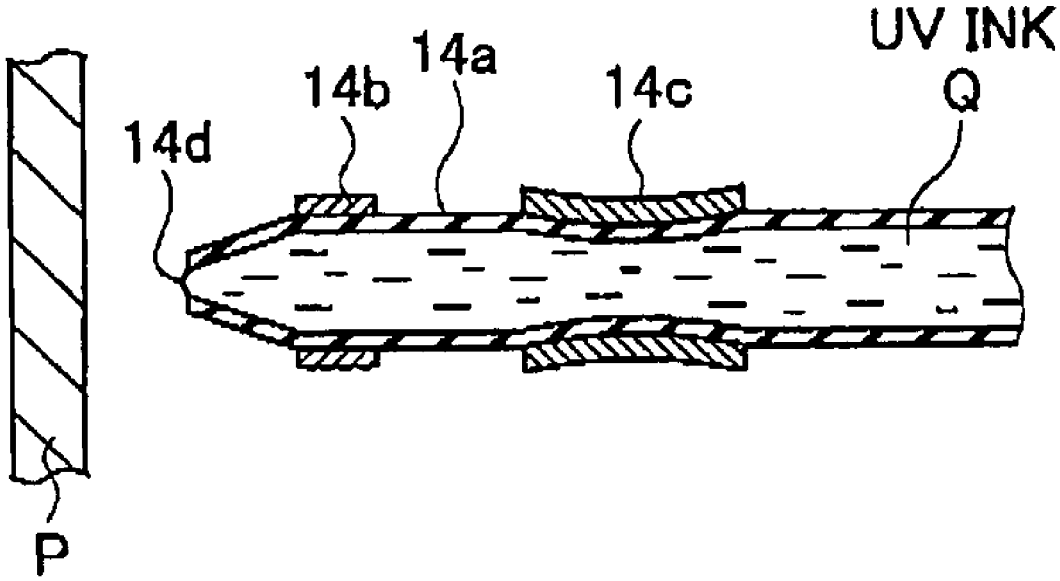
FIG. 8 is a cross sectional view showing a schematic constitution of the peripheral portion of a nozzle of the inkjet head shown in FIG. 7.

FIG. 7 is a perspective view showing the schematic constitution of the external appearance of the inkjet head 14, and FIG. 8 is a cross sectional view showing the schematic constitution of the peripheral portion of one nozzle 14*a* of the inkjet head 14.

The inkjet head 14 has a plurality of nozzles 14*a* for ejecting ink droplets, and each of the nozzles 14*a* is provided with a recording electrode 14*b* and a piezoelectric element 14*c*.

Each nozzle 14*a* is composed of an insulating material, has a columnar shape, and is provided with an opening having a diameter of 200 μm or less at its tip. In addition, the inside of each nozzle 14*a* is filled with UV ink. Part of the ink filling each nozzle 14*a* projects from the opening to form a hemispherical or cone-like meniscus. In this embodiment, each nozzle is of a columnar shape. However, the present invention is not limited to this, and each nozzle may be of a rectangular parallelopiped shape.

The surface in which the openings of the nozzles 14*a* are formed is preferably formed of a material having high surface energy such as Teflon (registered trademark). The formation of the surface in which the openings of the nozzles 14*a* are formed of a material having high surface energy can prevent the ink from spreading from the opening. The prevention of the spreading of the ink can prevent a meniscus shape from, for example, becoming unstable or remaining as a stain when a power supply is turned off to have an adverse effect on any subsequent recording.

In addition, an ink chamber (not shown) for storing and replenishing ink Q is connected to each nozzle 14*a*. The UV ink chamber includes pressure means (not shown), and supplies the UV ink Q to each nozzle 14*a* under pressure by using the pressure means. The pressure means continuously or intermittently supplies the UV ink Q under a pressure appropriate for maintaining the constant shape of a meniscus 14*d*.

Further, the UV ink chamber is preferably provided with heating means so that the temperature of the UV ink is maintained at a predetermined temperature.

The recording electrode 14*b* is disposed on the outer wall side of the tip portion of each nozzle 14*a*, and is connected to a not shown controller. The controller controls the voltage value and pulse width of a driving voltage to be applied to the recording electrode 14*b* when a droplet is ejected or when no droplet is ejected.

The application of a predetermined voltage in accordance with a first ejection signal from the controller to the recording electrode 14*b* causes a droplet to be ejected from the opening at the tip of each nozzle 14*a*.

The recording electrode 14*b* may be disposed on either the inner wall side or outer wall side of each nozzle 14*a*, however, the electrode is preferably provided for the outer wall side of each nozzle 14*a* as in the case of this embodiment. Providing the recording electrode 14*b* for the outer wall side of each nozzle 14*a* can eliminate an influence of, for example, corrosion due to, for example, the contact of the electrode with the UV ink.

In addition, a distance between the recording electrode 14*b* and the tip of the nozzle 14*a* is not particularly limited. For example, in this embodiment, even when the position of the recording electrode 14*b* is made distant from the tip of the nozzle 14*a* without any change in applied voltage so that the recording electrode is disposed at a position distant from the tip of the nozzle 14*a* by 10 cm or longer, a droplet can be suitably ejected.

The inkjet head 14 of this embodiment preferably includes the piezoelectric element 14*c*.

The piezoelectric element 14*c* is disposed on the outer wall surface of each nozzle 14*a* on an ink flow upstream side with respect to the recording electrode. The piezoelectric element 14*c* is made of a material which is deformable in response to an applied voltage, and pressurizes the UV ink filled in the nozzle in synchronization with the application of a voltage to the recording electrode 14*b*. Pressurization by using the piezoelectric element 14*c* as described above enables additionally stable recording to be performed.

In this embodiment, each nozzle 14*a* is formed of an insulating material, and is caused to eject a droplet by applying a predetermined voltage to the recording electrode 14*b* in accordance with the first ejection signal. However, the present invention is not limited to this. For example, when UV ink which causes ignorable corrosion or clogging upon contact with a nozzle is used as the UV ink, the following constitution may be adopted: each nozzle is made of a metal, a recording electrode is not particularly provided, and a signal voltage is directly applied to the nozzle, so that a droplet is ejected.

A UV ink ejection operation by the inkjet head 14 will be described.

Each nozzle 14*a* is supplied with the UV ink from the ink chamber under pressure, and the meniscus of the UV ink is formed at the opening at the tip of the nozzle 14*a*.

When a predetermined voltage is applied from the controller to the recording electrode 14*b* in accordance with the first ejection signal in this state, the meniscus vibrates (or, expands and contracts) from the tip of the nozzle 14*a* toward the side of the printing base plate P, and adheres in an expanded state to the printing base plate P, thereby forming a dot. Alternatively, the tip of the meniscus splits, and a split droplet is ejected toward the printing base plate P, and adheres to the plate, thereby forming a dot.

As described above, the voltage to be applied to the recording electrode 14*b* is controlled in accordance with the first ejection signal, and a dot of the UV ink is formed on the printing base plate P, so that an image area is formed.

The following method is also employed in the inkjet head; the entirety of the head is heated with a heater or the like to a regulated temperature, so that the viscosity of the ink is reduced to such an extent that the ink can be easily ejected.

Next, a printing base plate that may be suitably used in the plate making apparatus to which the inkjet drawing device of the present invention is applied will be described.

The printing base plate that may be suitably used in the plate making apparatus to which the present invention is applied can be obtained by forming a specific ink receiving layer on an appropriate support (substrate). The support to be used in its production is not particularly limited as long as the support is a dimensionally stable plate having required strength and durability. Examples of the support include paper; paper on which a plastic sheet (made of polyethylene, polypropylene, polystyrene or the like) is laminated; a metal plate (made of aluminum, zinc, copper, or the like); a plastic film (made of cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinyl acetal, or the like); and paper or a plastic film on which a metal is laminated or vapor-deposited.

Of those, a polyester film or an aluminum plate is preferable in the present invention. Of those, the aluminum plate is particularly preferable because of its good dimensional stability and relatively low cost. Preferable examples of the aluminum plate include a pure aluminum plate and an alloy plate mainly composed of aluminum and containing one or more dissimilar elements in trace amounts. A plastic film on which aluminum is laminated or vapor-deposited may also be used. Exemplary dissimilar elements to be incorporated in the aluminum alloy include silicon, iron, manganese, copper, magnesium, chromium, zinc, bismuth, nickel, and titanium. The content of the dissimilar element in the alloy is at most 10 wt %. In the present invention, a surface-treated aluminum plate, and a support obtained by providing a sol-gel hydrophilic layer on a polyester film are preferable. The plate and the support will be described below.

(Aluminum Support)

Pure aluminum is particularly preferable as the aluminum material in the present invention, but completely pure aluminum is difficult to produce in the current refining technology. So, the aluminum material may contain one or more dissimilar elements in trace amounts.

As described above, the composition of the aluminum plate to be applied to the present invention is not particularly limited, but an aluminum plate made of a material conventionally known and used may be appropriately used. The thickness of the aluminum plate to be used in the present invention is about 0.1 mm to 0.6 mm, preferably 0.15 mm to 0.4 mm, and more preferably 0.15 mm to 0.3 mm.

Such aluminum plate may be subjected, as required, to surface treatments such as surface graining treatment and anodic treatment. Hereinafter, the surface treatments will be briefly described.

Prior to surface graining of the aluminum plate, degreasing treatment with, for example, a surfactant, an organic solvent, or an alkaline aqueous solution is performed as desired for removing rolling oil on the plate surface. Surface graining treatment on the surface of the aluminum plate is performed by various methods. For example, the treatment is performed by a method involving surface mechanical graining, a method involving electrochemically dissolving and graining the surface, and a method involving chemically dissolving the surface in a selective manner. Any known techniques such as ball graining, brushing, blasting, and buffing may be used for the mechanical method. In addition, a method that involves graining in an electrolytic solution of hydrochloric acid or nitric acid with an alternating current or a direct current may be used for electrochemical graining. A method as disclosed in JP 54-63902 A in which mechanical graining and electrochemical graining are used in combination may also be employed.

After having undergone surface treatment such as anodic treatment, the aluminum plate is further subjected to hydrophilic treatment. Examples of the hydrophilic treatment include silicate treatment and sol-gel treatment.

(Silicate Treatment)

A printing base plate that may be suitably used in the plate making apparatus to which the present invention is applied is characterized in that the printing base plate has a silicate layer formed by depositing the solution to an amount of 2.0 to 25 $mg/m^2$. The silicate layer is formed by silicate treatment.

Hydrophilic treatment with an aqueous solution of an alkali metal silicate such as sodium silicate or potassium silicate may be performed in accordance with the methods and the procedures described in U.S. Pat. No. 2,714,066 and U.S. Pat. No. 3,181,461. Examples of the alkali metal silicate include sodium silicate, potassium silicate, and lithium silicate. The aqueous solution of the alkali metal silicate may contain an appropriate amount of sodium hydroxide, potassium hydroxide, lithium hydroxide, or the like. In addition, the aqueous solution of the alkali metal silicate may contain an alkaline earth metal salt or a Group 4 (Group IVA) metal salt. Examples of the alkaline earth metal salt include nitrates such as calcium nitrate, strontium nitrate, magnesium nitrate, and barium nitrate; sulfates; hydrochlorides; phosphates; acetates; oxalates; and borates. Examples of the Group 4 (Group IVA) metal salt include titanium tetrachloride, titanium trichloride, potassium titanium fluoride, potassium titanium oxalate, titanium sulfate, titanium tetraiodide, zirconyl chloride, zirconium dioxide, and zirconium tetrachloride. These alkaline earth metal salts and Group 4 (Group IVA) metal salts may be used alone or in combination of two or more.

In the present invention, a silicate must be deposited to an amount of 2.0 to 25 $mg/m^2$. The amount of deposition is preferably 2.0 to 20.0 $mg/m^2$, and more preferably 5.0 to 15.0 $mg/m^2$. At an amount of deposition of 2.0 $mg/m^2$ or more, ink blurring is suppressed, and scumming resistance is enhanced. An amount of deposition of 20.0 $mg/m^2$ or less is preferable because a lithographic printing plate obtained from the thus treated printing base plate has a long press life. Formation of the silicate layer having an amount of silicate deposition in excess of 25 $mg/m^2$ does not further enhance the properties and this range is disadvantageous in terms of cost. The silicate may be present on the anodized film in the form of a continuous layer or in an island shape.

The amount of silicate is measured in terms of the amount of silicon atoms ($mg/m^2$) by a calibration curve method using, for example, a fluorescent X-ray analyzer. To be more specific, the amount of silicon atoms can be measured from the peak height in the Si—Kα spectrum under the conditions indicated below using a fluorescent X-ray analyzer RIX 3000 (manufactured by Rigaku Corporation) under the following conditions.

Device: RIX 3000 manufactured by Rigaku Corporation
X-ray tube: Rh
Measurement spectrum: Si—Kα
Tube voltage: 50 kV
Tube current: 50 mA
Slit: coarse
Analyzing crystal: RX 4
Detector: F-PC
Analysis area: 30 mmΦ
Peak position (2θ): 144.75 deg.
Background (2θ): 140.70 deg., 146.85 deg.
Elapsed time: 80 sec/sample (Sol-Gel Hydrophilic Layer)

Prior to the formation of the ink receiving layer, it is also preferable to provide a hydrophilic layer surface having a sol-gel structure instead of the hydrophilic silicate layer.

In other words, a printing base plate may be produced by forming a sol-gel hydrophilic layer on the support prior to the formation of the ink receiving layer. The support is not particularly limited as long as the support is made from a dimensionally stable plate having required strength and durability. Examples of the support include paper; paper on which a plastic sheet (made of polyethylene, polypropylene, polystyrene or the like) is laminated; a metal plate (made of aluminum, zinc, copper, or the like); a plastic film (made of cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinyl acetal, or the like); and paper or a plastic film on which such metal is laminated or vapor-deposited.

Hereinafter, the constitution of the sol-gel hydrophilic layer will be described.

(Hydrophilic Binder)

In the present invention, the sol-gel hydrophilic layer contains a hydrophilic binder. The hydrophilic binder is preferably a sol-gel transformable material composed of a system of a metal hydroxide and a metal oxide, and a sol-gel transformation system having the property of forming the gel structure of polysiloxane is most preferably used.

The binder acts as a dispersion medium for the components of the hydrophilic layer, and fulfills various purposes such as an improvement in physical strength of the layer, an improvement in mutual dispersion of the components in the composition constituting the layer, an improvement in application property, an improvement in printability, and the convenience in plate making operation.

The content of the hydrophilic binder is preferably 30 wt % or more, and more preferably 35 wt % or more with respect to the total solid content of the hydrophilic layer. When the content is 30 wt % or less, sufficiently high water resistance and abrasion resistance cannot be imparted to the hydrophilic layer.

An organic polymer compound for imparting appropriate strength and surface hydrophilicity to the hydrophilic layer of the printing base plate can be used for the hydrophilic polymer binder that may be suitably used in the hydrophilic layer. Specific examples of the organic polymer compound include polyvinyl alcohol (PVA); modified PVA such as carboxy-modified PVA; starch and a derivative thereof; cellulose derivatives such as carboxymethylcellulose and hydroxyethylcellulose; casein; gelatin; polyvinyl pyrrolidone; a vinyl acetate-crotonic acid copolymer; a styrene-maleic acid copolymer; polyacrylic acid and a salt thereof; polyacrylamide; a water-soluble acrylic copolymer containing a water-soluble acrylic monomer such as acrylic acid or acrylamide as its main component; and other water-soluble resins.

Examples of a water resistance-imparting agent for curing the organic polymer compound through cross-linking include glyoxal; initial condensation products of aminoplasts such as a melamine-formaldehyde resin and a urea-formaldehyde resin; a methylolated polyamide resin; a polyamide-polyamine-epichlorohydrin adduct; a polyamide-epichlorohydrin resin; and a modified polyamide-polyimide resin. In addition, a cross-linking catalyst such as ammonium chloride or a silane coupling agent may be used in combination.

A sol-gel transformable system that may be particularly preferably applied to the present invention is described in detail in, for example, publications such as "Science of Sol-gel Method", Sumio Sakka, published by Agne Shofu Publishing Inc. (1988) and "Technology for Producing Functional Thin Films by Latest Sol-gel Method" Hiroshi Hirashima, published by Sogo Gijutsu Center (1992).

More specifically, the sol-gel transformable system is a polymer which has a reticulate structure formed by bonding groups of polyvalent elements via oxygen atoms and which also has a resinous structure in which unbound hydroxy and alkoxy groups of the polyvalent metals are present. Before being applied, the polymer contains many alkoxy and hydroxy groups and is in a sol state. After application of the polymer, ester bonding proceeds to strengthen the reticulate resinous structure, thus gelating the polymer. The polymer has the property that the degree of hydrophilicity of the resinous structure changes and also has the function that some of hydroxy groups bind to solid fine particles to modify their surfaces to thereby change the degree of hydrophilicity. Examples of the polyvalent element in a hydroxy group-and/or alkoxy group-containing compound in which sol-gel transformation is performed include aluminum, silicon, titanium and zirconium. These polyvalent elements can be used in the present invention, but a sol-gel transformation system based on siloxane bond that may be most preferably used will be described below. The sol-gel transformation system using aluminum, titanium, or zirconium can be performed by replacing silicon in the following description with each of the elements.

The hydrophilic matrix formed by sol-gel transformation is preferably a resin having siloxane bond and silanol group. The hydrophilic layer in a direct drawing type lithographic printing base plate according to the present invention is formed as follows: A coating solution of a sol system that contains a silane compound having at least one silanol group is applied; then, the hydrolytic condensation of the silanol group proceeds over time to form the siloxane skeleton structure, thus allowing gelation to proceed. The siloxane resin that may form a gel structure is represented by the general formula (I), and the silane compound having at least one silanol group is represented by the general formula (II). A substance system in the hydrophilic layer whose property changes from hydrophilicity to hydrophobicity is not necessarily composed of a single silane compound represented by the general formula (II), but in general, may be composed of an oligomer obtained by polymerization of a silane compound through partial hydrolysis or a mixed composition of a silane compound and an oligomer thereof.

General formula (I)

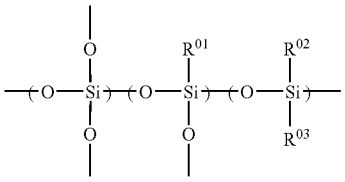

The siloxane resin represented by the general formula (I) is formed from a dispersion containing at least one silane compound represented by the general formula (II) through sol-gel transformation. At least one of $R^{01}$ to $R^{03}$ in the general formula (I) represents hydroxy group, and the others each represent an organic residue selected from $R^0$ and $Y^1$ in the general formula (II).

$$(R^0)_n Si(Y^1)_{4-n}$$ General formula (II)

In the general formula (II), $R^0$ represents hydroxy group, a hydrocarbon group, or a heterocyclic group. $Y^1$ represents hydrogen atom, a halogen atom, —$OR^{11}$, —$OCOR^{12}$, or —$N(R^{13})(R^{14})$ in which $R^{11}$ and $R^{12}$ each independently represent a hydrocarbon group and $R^{13}$ and $R^{14}$ may be identical to or different from each other, and each independently represent hydrogen atom or a hydrocarbon group. n represents an integer of 0 to 3.

Examples of the hydrocarbon group and heterocyclic group represented by hu 0 in the general formula (II) include:

linear or branched alkyl groups having 1 to 12 carbon atoms (such as methyl group, ethyl group, propyl group, butyl group, pentyl group, hexyl group, heptyl group, octyl group, nonyl group, decyl group, and dodecyl group) which may be mono- or multisubstituted by one or more substituents selected from among halogen atoms (such as chlorine atom, fluorine atom, and bromine atom); hydroxy group; thiol group; carboxy group; sulfo group; cyano group; epoxy group; a —$OR^1$ group (wherein $R^1$ represents methyl group, ethyl group, propyl group, butyl group, heptyl group, hexyl group, octyl group, decyl group, propenyl group, butenyl group, hexenyl group, octenyl group, 2-hydroxyethyl group, 3-chloropropyl group, 2-cyanoethyl group, N,N-dimethylaminoethyl group, 2-bromoethyl group, 2-(2-methoxyethyl) oxyethyl group, 2-methoxycarbonylethyl group, 3-carboxypropyl group, benzyl group, or the like.); a —$OCOR^1$ group (wherein $R^2$ is as defined for $R^1$); a —$COOR^2$ group; a —$COR^2$ group; a —$N(R^3)(R^3)$ ($R^3$ represents hydrogen atom or is as defined for $R^1$, and both $R^3$ may be identical to or different from each other); a —$NHCONHR^2$ group; a —$NHCOOR^2$ group; a —$Si(R^2)_3$ group; a —$CONHR^3$ group; and a —$NHCOR^2$ group;

linear or branched alkenyl groups having 2 to 12 carbon atoms (such as vinyl group, propenyl group, butenyl group, pentenyl group, hexenyl group, octenyl group, decenyl group, and dodecenyl group) which may be substituted by the substituents as illustrated above for the alkyl group;

aralkyl groups having 7 to 14 carbon atoms (such as benzyl group, phenethyl group, 3-phenylpropyl group, naphthylmethyl group, 2-naphthylethyl group) which may be mono- or multisubstituted by the substituents as illustrated above for the alkyl group;

alicyclic groups having 5 to 10 carbon atoms (such as cyclopentyl group, cyclohexyl group, 2-cyclohexylethyl group, 2-cyclopentylethyl group, norbonyl group and adamantyl group) which may be mono- or multisubstituted by the substituents as illustrated above for the alkyl group;

aryl groups having 6 to 12 carbon atoms (such as phenyl group and naphthyl group) which may be mono- or multisubstituted by the substituents as illustrated above for the alkyl group;

heterocyclic groups having at least one kind of atom selected from nitrogen atom, oxygen atom, and sulfur atom (as exemplified by pyran ring, furan ring, thiophene ring, morpholine ring, pyrrole ring, thiazole ring, oxazole ring, pyridine ring, piperidine ring, pyrrolidone ring, benzothiazole ring, benzoxazole ring, quinoline ring, and tetrahydrofuran ring) which may be ring-fused and mono- or multisubstituted by the substituents as illustrated above for the alkyl group.

—$OR^{11}$ group, —$OCOR^{12}$ group, and $N(R^{13})(R^{14})$ group represented by $Y^1$ in the general formula (II) are described below. In —$OR^{11}$ group, $R^{11}$ represents an aliphatic group having 1 to 10 carbon atoms which may be substituted. Examples of the aliphatic group include methyl group, ethyl group, propyl group, butoxy group, heptyl group, hexyl group, pentyl group, octyl group, nonyl group, decyl group, propenyl group, butenyl group, heptenyl group, hexenyl group, octenyl group, decenyl group, 2-hydroxyethyl group, 2-hydroxypropyl group, 2-methoxyethyl group, 2-(methoxyethyloxo)ethyl group, 2-(N,N-diethylamino)ethyl group, 2-methoxypropyl group, 2-cyanoethyl group, 3-methyloxapropyl group, 2-chloroethyl group, cyclohexyl group, cyclopentyl group, cyclooctyl group, chlorocyclohexyl group, methoxycyclohexyl group, benzyl group, phenethyl group, dimethoxybenzyl group, methylbenzyl group, and bromobenzyl group.

In —$OCOR^{12}$ group, $R^{12}$ represents an aliphatic group as defined for $R^{11}$ or an aromatic group having 6 to 12 carbon atoms which may be substituted (examples of the aromatic group are as illustrated above for the aryl group in $R^0$). In —$N(R^{13})(R^{14})$ group, $R^{13}$ and $R^{14}$ may be identical to or different from each other, and each represent hydrogen atom or an aliphatic group having preferably 1 to 10 carbon atoms which may be substituted (examples of the aliphatic group are as defined above for $R^{11}$ of —$OR^{11}$ group). The total number of carbon atoms in $R^{13}$ and $R^{14}$ is more preferably 16 or less. Specific examples of the silane compound represented by the general formula (II) include: tetrachlorosilane, tetrabromosilane, tetramethoxysilane, tetraethoxysilane, tetraisopropoxysilane, tetrabutoxysilane, methyltrichlorosilane, methyltribromosilane, methyltrimethoxysilane, methyltriethoxysilane, methyltriisopropoxysilane, methyltri-t-butoxysilane, ethyltrichlorosilane, ethyltribromosilane, ethyltrimethoxysilane, ethyltriethoxysilane, ethyltriisopropoxysilane, ethyltri-t-butoxysilane, n-propyltrichlorosilane, n-propyltribromosilane, n-propyltrimethoxysilane, n-propyltriethoxysilane, n-propyltriisopropoxysilane, n-propyltri-t-butoxysilane, n-hexyltrichlorosilane, n-hexyltribromosilane, n-hexyltrimethoxysilane, n-hexyltriethoxysilane, n-hexyltriisopropoxysilane, n-hexyltri-t-butoxysilane, n-decyltrichlorosilane, n-decyltribromosilane, n-decyltrimethoxysilane, n-decyltriethoxysilane, n-decyltriisopropoxysilane, n-decyltri-t-butoxysilane, n-octadecyltrichlorosilane, n-octadecyltribromosilane, n-octadecyltrimethoxysilane, n-octadecyltriethoxysilane, n-octadecyltriisopropoxysilane, n-octadecyltri-t-butoxysilane, phenyltrichlorosilane, phenyltribromosilane, phenyltrimethoxysilane, phenyltriethoxysilane, phenyltriisopropoxysilane, phenyltri-t-butoxysilane, dimethoxydiethoxysilane, dimethyldichlorosilane, dimethyldibromosilane, dimethyldimethoxysilane, dimethyldiethoxysilane, diphenyldichlorosilane, diphenyldibromosilane, diphenyldimethoxysilane, diphenyldiethoxysilane, phenylmethyldichlorosilane, phenylmethyldibromosilane, phenylmethyldimethoxysilane, phenylmethyldiethoxysilane, triethoxyhydrosilane, tribromohydrosilane, trimethoxyhydrosilane, isopropoxyhydrosilane, tri-t-butoxyhydrosilane, vinyltrichlorosilane, vinyltribromosilane, vinyltrimethoxysilane, vinyltriethoxysilane, vinyltriisoproxysilane, vinyltri-t-butoxysilane, trifluoropropyltrichlorosilane, trifluoropropyltribromosilane, trifluoropropyltrimethoxysilane, trifluoropropyltriethoxysilane, trifluoropropyltriisopropoxysilane, trifluoropropyltri-t-butoxysilane, γ-glycidoxypropylmethyldimethoxysilane, γ-glycidoxypropylmethyldiethoxysilane, γ-glycidoxypropyltrimethoxysilane, γ-glycidoxypropyltriethoxysilane, γ-glycidoxypropyltriisopropoxysilane, γ-glycidoxypropyltri-t-butoxysilane, γ-methacryloxypropylmethyldimethoxysilane, γ-methacryloxypropylmethyldiethoxysilane, γ-methacryloxypropyltrimethoxysilane, γ-methacryloxypropyltriisopropoxysilane, γ-methacryloxypropyltri-t-butoxysilane, γ-aminopropylmethyldimethoxysilane, γ-aminopropylmethyldiethoxysilane, γ-aminopropyltrimethoxysilane, γ-aminopropyltriethoxysilane, γ-aminopropyltriisopropoxysilane, γ-aminopropyltri-t-butoxysilane, γ-mercaptopropylmethyldimethoxysilane, γ-mercaptopropylmethyldiethoxysilane, γ-mercaptopropyltrimethoxysilane, γ-mercaptopropyltriethoxysilane, γ-mercaptopropyltriisopropoxysilane, γ-mercaptopropyltri-t-butoxysilane, β-(3,4-epoxycyclohexyl)ethyltrimethoxysilane, and β-(3,4-epoxycyclohexyl)ethyltriethoxysilane.

A compound of a metal such as Ti, Zn, Sn, Zr or Al that can bind to a resin to form a film at the time of sol-gel transformation may be used in combination with the silane compound represented by the general formula (II) as used in forming the hydrophilic layer according to the present invention. Examples of such metal compound include $Ti(OR^2)_4$ (wherein $R^2$ represents methyl group, ethyl group, propyl group, butyl group, pentyl group, or hexyl group), $TiCl_4$, $Zn(OR^2)_2$, $Zn(CH_3COCHCOCH_3)_2$, $Sn(OR^2)_4$, $Sn(CH_3COCHCOCH_3)_4$, $Sn(OCOR^2)^4$, $SnCl_4$, $Zr(OR^2)_4$, $Zr(CH_3COCHCOCH_3)_4$, and $Al(OR^2)_3$.

In addition, a hydrophilic polymer having a silane coupling group at the terminal of the main chain of the polymer and/or a crosslinking agent may be added to the matrix with a gel structure for the purpose of, for example, improving physical properties such as film strength and flexibility, improving application property, and adjusting hydrophilicity.

Examples of the hydrophilic polymer having a silane coupling group at the terminal of the polymer main chain include polymers each represented by the following general formula (1):

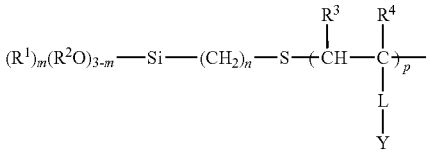

(1)

wherein, $R^1$, $R^2$, $R^3$, and $R^4$ each represent hydrogen atom or a hydrocarbon group having not more than 8 carbon atoms, m represents 0, 1, or 2, n represents an integer of 1 to 8, p represents an integer of 30 to 300, Y represents —NH-$COCH_3$, —$CONH_2$, —$CON(CH_3)_2$, —$COCH_3$, —$OCH_3$, —OH, —$CO_2M$, or $CONHC(CH_3)_2SO_3M$, and M represents any one selected from the group consisting of hydrogen atom, an alkali metal, an alkaline earth metal, and an onium, L represents a single bond or an organic linking group. The term "organic linking group" as used herein refers to a polyvalent linking group composed of non-metal atoms, specifically, a group composed of 1 to 60 carbon atoms, 0 to 10 nitrogen atoms, 0 to 50 oxygen atoms, 1 to 100 hydrogen atoms, and 0 to 20 sulfur atoms. More specific examples of the linking group include the following structural units and a group obtained by combining two or more thereof.

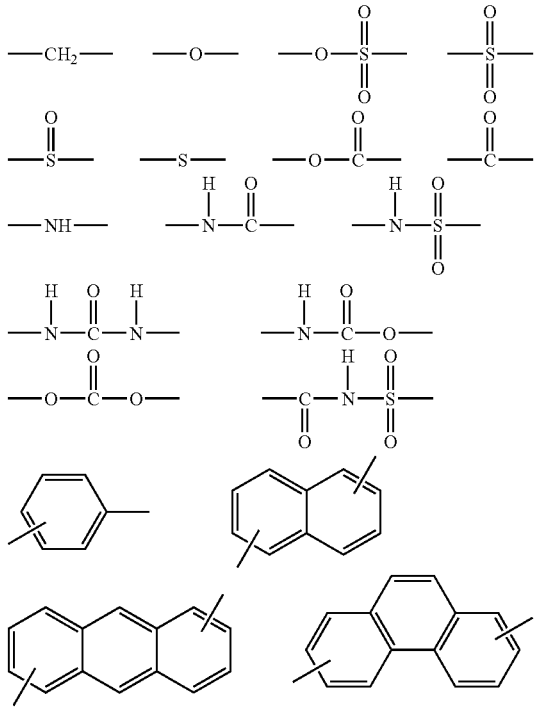

Specific examples of the hydrophilic polymer having a silane coupling group represented by the general formula (1) include the polymers illustrated below. In each of the following specific examples, p can take any value between 100 and 250.

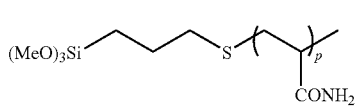

(1)

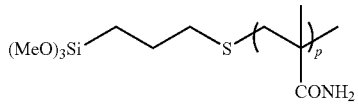

(2)

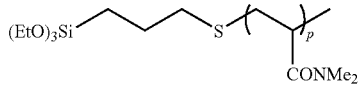

(3)

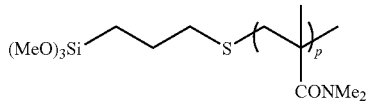

(4)

-continued (5)

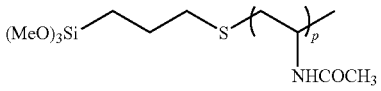

(6)

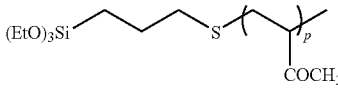

(7)

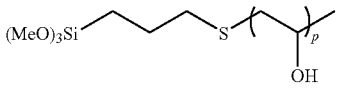

(8)

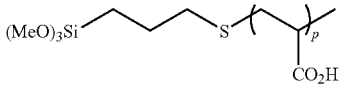

(9)

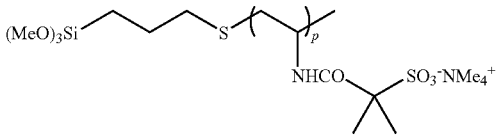

(10)

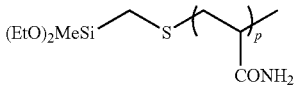

(11)

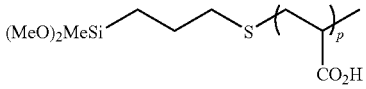

The hydrophilic polymer according to the present invention can be synthesized by radical polymerization of a radically polymerizable monomer represented by the general formula (2) and a silane coupling agent represented by the general formula (3) and having a chain transfer ability in radical polymerization. Since the silane coupling agent represented by the formula (3) has a chain transfer ability, a polymer having a silane coupling group introduced in the terminal of the main chain of the polymer can be synthesized in radical polymerization.

(2)

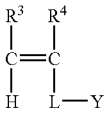

(3)

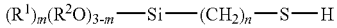

As described above, it is particularly preferable to provide the hydrophilic layer produced by a sol-gel method between the ink receiving layer and the support.

(Inorganic Fine Particles)

Further, the hydrophilic layer having a sol-gel structure may contain inorganic fine particles for improving the strength of the cured film in the image area and for improving the on-press developability in the non-image area.

Preferable examples of the inorganic fine particles include silica, alumina, magnesium oxide, titanium oxide, magnesium carbonate, calcium alginate, and mixtures thereof. Even if those fine particles are not capable of photothermal conversion, they can be used for strengthening the film while enhancing the interfacial adhesiveness owing to surface roughening.

The inorganic fine particles have an average particle diameter of preferably 5 nm to 10 μm, and more preferably 0.5 to 3 μm. When the average particle diameter is within the above-mentioned range, the inorganic fine particles can be stably dispersed in the hydrophilic layer to keep the film strength sufficiently high, whereby the non-image area which hardly causes scumming at the time of printing and is excellent in hydrophilicity can be formed.

The inorganic fine particles as described above are easily available as a commercial product such as a colloidal silica-dispersed product.

The content of the inorganic fine particles is preferably 20 wt % or less, and more preferably 10 wt % or less with respect to the total solid content of the hydrophilic layer.

(Formation of Sol-Gel Hydrophilic Layer)

The sol-gel hydrophilic layer is obtained by applying a coating solution prepared by dispersing or dissolving the above-mentioned necessary components in a solvent. Examples of the solvent that may be used include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulforane, γ-butyrolactone, toluene, and water. However, the solvent is not limited thereto. Those solvents are used alone or as a mixture of two or more thereof. The concentration of the solid content in the coating solution is preferably 1 to 50 wt %.

The sol-gel hydrophilic layer according to the present invention can be formed as follows: The above-mentioned respective components that may be the same or different are dispersed or dissolved in a single solvent or different solvents to prepare coating solutions, which are then used to repeat application and drying processes several times to thereby form the sol-gel hydrophilic layer.

The sol-gel hydrophilic layer can be formed by applying the hydrophilic coating solution-prepared as described above to the support surface and drying the applied solution. The thickness of the sol-gel hydrophilic layer can be selected depending on the purpose. In general, the amount of solution applied and dried is in the range of 0.5 to 5.0 g/m$^2$, and preferably 1.0 to 3.0 g/m$^2$. An amount of less than 0.5 g/m$^2$ is not preferable because a hydrophilic effect is hardly exerted. An amount in excess of 5.0 g/m$^2$ is not preferable because the strength of the layer tends to reduce.

(Ink Receiving Layer)

As described above, the ink receiving layer is preferably formed on the surface of the hydrophilic layer chosen from the silicate layer and the sol-gel hydrophilic layer for a printing base plate that may be advantageously used in the plate making apparatus to which the present invention is applied. The ink receiving layer is a layer containing 1.0 to 50.0 mg/m$^2$ of an organic fluorine compound having 5 or more fluorine atoms per molecule, or a layer containing 1.0 to 50 mg/m$^2$ of an organic fluorine compound having 5 or more fluorine atoms per molecule and 1.0 to 50.0 mg/m$^2$ of a hydrophilic resin.

Such ink receiving layer is formed on the surface of the hydrophilic silicate layer or the hydrophilic layer having a sol-gel structure which was provided in advance on the support.

The printing base plate is preferably obtained by providing the ink receiving layer on the silicate layer provided by silicate treatment on the surface of the anodized layer formed on the aluminum substrate, or the sol-gel hydrophilic layer formed on the substrate. An organic fluorine compound having 5 or more fluorine atoms is preferably used in an amount of 50 mg/m$^2$ or less as the component for the ink receiving layer. Setting the content of the organic fluorine compound within the range of 1.0 to 50.0 mg/m$^2$ enables compatibility between excellent adhesiveness with the image area and surface hydrophilicity to be achieved when producing a lithographic printing plate, thus realizing excellent scumming resistance of the non-image area and long press life.

(Organic Fluorine Compound Having 5 or More Fluorine Atoms)

The organic fluorine compound as the component for the ink receiving layer preferably has 5 or more fluorine atoms per molecule, or when the compound is a polymer compound, 5 or more fluorine atoms per structural unit. An effect of suppressing ink blurring can be advantageously achieved by setting the number of fluorine atoms to 5 or more. It is preferable for the organic fluorine compound to be water-soluble and have surface activity.

A preferable fluorine compound according to the present invention is represented by the general formula $R_F$-Rpol. In the formula, $R_F$ represents a linear or branched perfluoroalkyl group having 3 or more carbon atoms; and Rpol represents a polar group such as a carboxylic acid or a salt thereof; a sulfonic acid or a salt thereof; phosphoric acid or a salt thereof; phosphonic acid or a salt thereof; amino group or a salt thereof; a quaternary ammonium salt; a polyethyleneoxy skeleton; a polypropyleneoxy skeleton; a sulfonamide group; an ether group; or a betaine structure. Of those, one having the structure of a sulfoxyl group or a salt thereof is preferable because it hardly interacts with a silicate and can be developed on press. In addition, RE more preferably represents a group having a $C_nF_{2n+1}C_mH_{2m}COO$— skeleton from the viewpoint of suppressed ink blurring; $R_F$ even more preferably represents a group having 2 or more $C_nF_{2n+1}C_mH_{2m}COO$— skeletons in one molecule. In this formula, n represents an integer of 2 or more, and m represents an integer of 1 or more.

Hereinafter, specific examples [(F-1) to (F-19)] of the fluorine compound that may be preferably used in the present invention are illustrated below. However, the present invention is not limited to those examples.

(F-1)

$C_3F_7COOH$ (F-2)

$C_5F_{11}SO_2N(C_2H_5)COOK$ (F-3)

$C_5F_{11}SO_2NHC_3H_6N^+(H)(CH_3)_2\ Cl^-$ (F-4)

$C_7F_{15}CONHC_3H_6N^+(CH_3)_2CH_2CH_2COO^-$ (F-5)

$C_8F_{17}SO_2N(C_2H_5)C_2H_4(OC_2H_4)_{10}OH$

-continued (F-6)

$C_6F_{13}SO_2N(CH_2COO^-)C_3H_6N^+(CH_3)_2$ (F-7)

$C_6F_{13}CH_2CH_2SO_3H$ (F-8)

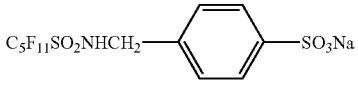

(F-9)

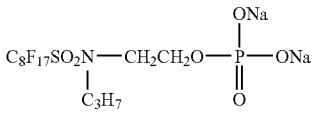

(F-10)

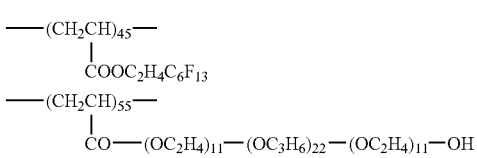

Mw: 30,000

(F-11)

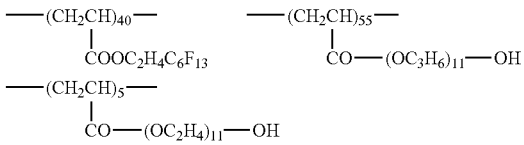

Mw: 30,000

(F-12)

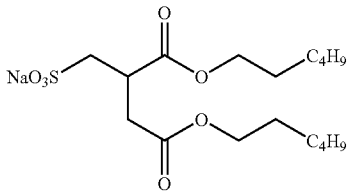

(F-13)

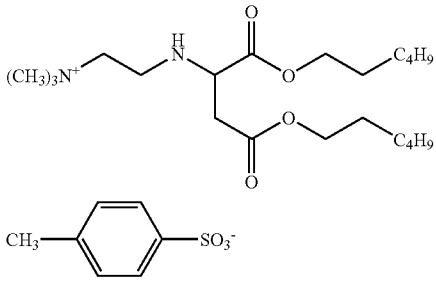

(F-14)

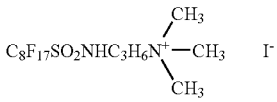

(F-15)

$C_8F_{17}SO_3K$ (F-16)

$C_8F_{17}SO_2N(C_3H_7(n))CH_2COOK$ (F-17)

$C_8F_{17}SO_2N(C_3H_7)C_2H_4(OC_2H_4)O(CH_2)_4SO_3Na$

-continued (F-18)

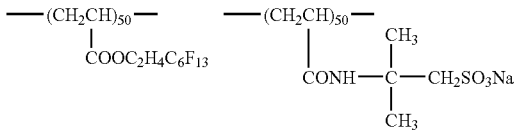

Mw: 30,000

(F-19)

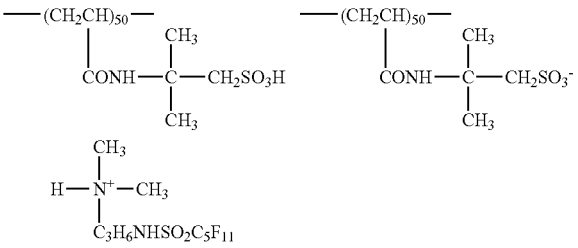

Mw: 100,000

A fluorine-based polymer compound may be used for the fluorine compound according to the present invention. A fluorine-based polymer compound which acts as a surfactant and is water-soluble is particularly preferable.

A specific example of a polymeric fluorochemical surfactant is a copolymer of an acrylate or methacrylate having a fluoroaliphatic group and poly(oxyalkylene)acrylate or poly (oxyalkylene)methacrylate. The copolymer preferably includes 7 to 60 wt % of the fluoroaliphatic group-containing acrylate or methacrylate as the monomer unit on the basis of the weight of the copolymer. The copolymer appropriately has a molecular weight of 3,000 to 100,000.

The fluoroaliphatic group is preferably one which has 3 to 20 carbon atoms; may be linear or branched; and contains 40 wt % or more of fluorine, and at least 3 carbon atoms sufficiently fluorinated at its terminal. Specific examples of the acrylate or methacrylate having the fluoroaliphatic group include (N-butyl perfluorooctane sulfonamide)ethyl acrylate; (N-propyl perfluorooctane sulfonamide)ethyl acrylate; and (methyl perfluorooctane sulfonamide)ethyl acrylate. The molecular weight of the polyoxyalkylene group in poly(oxyalkylene)acrylate or methacrylate is preferably 200 to 3,000. Examples of the oxyalkylene group include oxyethylene, oxypropylene, and oxybutylene groups. Of those, oxyethylene and oxypropylene groups are preferable. For example, an acrylate or methacrylate having 8 to 15 moles of oxyethylene group added thereto is used. Foaming property may also be suppressed by adding, for example, a dimethylsiloxane group to the terminal of the polyoxyalkylene group as required.

The fluorochemical surfactant as described above is in general commercially available, and a commercial product may be used in the present invention. Two or more kinds of fluorochemical surfactants may be used in combination.

Examples of the commercially available product include: Surflon S-111, S-112, S-113, S-121, S-131, S-141, S-145, S-381, and S-382 (manufactured by Asahi Glass Co., Ltd.); Megaface F-110, F120, F-142D, F-150, F-171, F177, and F781 (manufactured by Dainippon Ink and Chemicals, Inc.); Fluorad FC-93, FC-95, FC-98, FC-129, FC135, FX-161, FC170C, FC-171, and FC176 (manufactured by Sumitomo 3M Limited); and FT-248, FT-448, FT-548, FT-624, FT-718, and FT-738 (manufactured by Bayer Japan Ltd.).

(Use in Combination with Hydrophilic Resin)

The ink receiving layer can be obtained by blending such organic fluorine compound and a hydrophilic resin. Use of the organic fluorine compound in combination with the hydrophilic resin enables the scumming resistance to be further enhanced while suppressing ink blurring. In this case, the content of the organic fluorine compound is in the range of 1.0 to 50 mg/m$^2$, and preferably 2.0 to 10 mg/m$^2$, and the content of the hydrophilic resin is in the range of 1.0 to 50 mg/m$^2$, and preferably 2.0 to 20.0 mg/m$^2$. Use of the organic fluorine compound in combination with the hydrophilic resin further enhances the ink repellency in the non-image area.

Any water-soluble resin can be used for the hydrophilic resin without any problem. Specific examples of the hydrophilic resin include water-soluble cellulose having a carboxylic acid or a salt thereof (e.g., carboxymethylcellulose); an acrylic or methacrylic polymer, or an copolymer thereof; an acrylic, methacrylic, vinyl-based, or styrene-based hydrophilic resin having a sulfonic group or a salt thereof; a hydrophilic resin containing an amide group such as polyacrylamide or polyvinyl pyrrolidone; a hydrophilic resin having amino group; and a hydrophilic resin having phosphoric acid or a salt thereof such as phosphoric acid-modified starch described in JP 62-097892 A.

In addition, the ink receiving layer preferably includes an onium group-containing compound. The onium group-containing compound is described in detail in, for example, JP 2000-10292 A and JP 2000-108538 A. A compound selected from the group consisting of polymer compounds each having a structural unit typified by, for example, poly(p-vinylbenzoic acid) in the molecule may also be used. More specific examples of those polymer compounds include a copolymer of p-vinylbenzoic acid and a vinyl benzyl triethyl ammonium salt, and a copolymer of p-vinylbenzoic acid and vinyl benzyl trimethyl ammonium chloride.

A copolymer described in JP 2005-125749 A which has a repeating unit containing at least one ethylenically unsaturated bond and a repeating unit containing at least one functional group that interacts with the support surface is also preferable.

Of those, a polymer having a sulfonate skeleton is particularly preferable because the polymer significantly suppresses ink blurring while enhancing scumming resistance.

The organic ink receiving layer can be formed by the following methods: a method that involves dissolving the above-mentioned organic compound in water, an organic solvent such as methanol, ethanol or methyl ethyl ketone, or a mixed solvent thereof to prepare a solution, applying the solution onto an aluminum plate, and drying the applied solution to form the layer, and a method that involves immersing an aluminum plate in the solution described above to cause the aluminum plate to adsorb the above-mentioned compound, washing the plate with water or the like, and drying the plate to form the organic ink receiving layer. In the former method, a solution containing the organic compound at a concentration of 0.005 to 10 wt % can be applied by various techniques. In the latter method, the solution has a concentration of 0.01 to 20 wt % and preferably 0.05 to 5 wt %, an immersion temperature of 20 to 90° C. and preferably 25 to 50° C., and an immersion time of 0.1 second to 20 minutes and preferably 2 seconds to 1 minute. The former method involving applying the solution is more preferable because the solution does not adsorb to the substrate and the plate exhibits high scumming resistance at the time of printing.

From the viewpoint of suppression of scumming at the time of printing, when the contact angle of water with respect to the substrate (as measured 10 seconds after 0.8 μl of water has been slowly dropped in the air onto the substrate) is 8° or less, scumming at the time of printing is suppressed.

Next, UV ink that may be suitably used in the present invention will be described.

From the viewpoint of ejection property, the UV ink that may be used in the present invention preferably has a viscosity in the range of 1 to 1,000 mPa·s and a surface tension in the range of 1 to 100 mN/m at a temperature during ink ejection. The UV ink more preferably has a viscosity in the range of 1 to 100 mPa·s and a surface tension in the range of 1 to 80 mN/m.

From the viewpoint of suppression of ink blurring, the printing base plate and the UV ink are preferably combined in such a manner that the contact angle of the UV ink with respect to the printing base plate (as measured 10 seconds after 0.8 μl of the ink has been slowly dropped in the air onto the substrate) is 30° or more. This combination enables ink blurring to be suppressed.

The UV ink (ultraviolet curable ink) that may be suitably used in the present invention can be produced by a known method described in, for example, "Practical Handbook of Latest UV Curing)" published by Technical Information Institute Co., Ltd. (25 Feb. 2005). The ink contains a polymerization initiator, and a polymerizable monomer or oligomer as its main components. The polymerization type includes radical polymerization type and ionic polymerization type such as cationic polymerization type. These types can be appropriately used in the present invention.

Examples of the polymerization initiator that may be advantageously used in the present invention include known photopolymerization initiators for radical polymerization or cationic polymerization to be used in the composition of an ultraviolet curable ink. Another photopolymerization initiator that may be used in combination in the present invention is a compound that causes a chemical change through the action of light or an interaction of a sensitizing dye with electrons in an excited state to produce at least one of a radical, an acid, and a base. To be specific, any photopolymerization initiator known to one skilled in the art can be used without any limitation. Preferable examples of the photopolymerization initiator include aromatic ketones; benzoin derivatives such as benzoin and benzoin ether; onium salts such as a sulfonium salt and an iodonium salt; organic peroxides; hexaaryl biimidazole compounds; ketoxime esters; borates; azinium compounds; metallocene compounds; and compounds each having a carbon-halogen bond. Each of those compounds, which has an ability to initiate polymerization with respect to ultraviolet light, may be spectrally sensitized with respect to visible light or infrared light as well by combination with an appropriate sensitizer.

Examples of the polymerizable monomer or oligomer that may be advantageously used in the present invention include known radically polymerizable or cationically polymerizable monomers or oligomers. Examples of the monomer or oligomer that may be used include (meth)acrylates; (meth)acrylamides; (meth)acrylic acid; maleic acid and a derivative thereof; styrenes; olefins; vinyl ethers; vinyl esters; epoxy compounds; oxetane compounds; and cyclic esters. In order that the dynamic properties of a formed image may be controlled, such compounds to be used in the present invention may be a combination of a monofunctional compound having one polymerizable functional group in the molecule and a polyfunctional compound having two or more polymerizable functional groups in the molecule.

The ink is preferably colored for the visibility of an image. A known dye or pigment may be used in coloring. A surfactant for improving ejection property, and/or a polymerization inhibitor for stability at the time of ink storage may also be added. Further, any of various polymers may be added for improving the dynamic properties of a formed image. Specific examples of the polymer that may be used include a (meth)acrylic polymer, a polyurethane resin, a polyamide resin, a polyester resin, an epoxy resin, a phenol resin, a polycarbonate resin, a polyvinyl butyral resin, a polyvinyl formal resin, polyvinyl alcohol, polyethylene glycol, polyethylene oxide, polypropylene glycol, a shellac resin, a vinyl resin, a rubber resin, a wax, and other natural resins.

In the present invention, ink free of any solvent may be used, but ink may include water or an organic solvent. Examples of the organic solvent that may be mixed include ketone solvents such as acetone and methyl ethyl ketone; alcohol solvents such as methanol, ethanol, propanol, 1-methoxy-2-propanol, ethylene glycol, diethylene glycol, dipropylene glycol, diethylene glycol monoethyl ether, tripropylene glycol, and tripropylene glycol monomethyl ether; aromatic solvents such as toluene; ester solvents such as ethyl acetate, butyl acetate, isopropyl acetate, and γ-butyrolactone; ether solvents such as tetrahydrofuran and diethylene glycol diethyl ether; and hydrocarbon solvents such as ISOPAR G (manufactured by Exxon).

Next, an example of the gum solution that may be advantageously used in the plate making apparatus to which the present invention is applied will be specifically described.

A desensitizing solution that may be used in desensitizing treatment for a lithographic printing plate using an aluminum plate for the support can be effectively used as the gum solution. Preferable examples of the desensitizing solution include aqueous solutions each containing at least one of a hydrophilic organic polymer compound; hexametaphosphoric acid and a salt of the acid; and phytic acid and a salt thereof.

Specific examples of the hydrophilic organic polymer compound include gum arabic; dextrin; an alginate such as sodium alginate; water-soluble celluloses such as carboxymethylcellulose, hydroxyethylcellulose, and hydroxypropylmethylcellulose; polyvinyl alcohol; polyvinyl pyrrolidone; polyacrylamide; a water-soluble copolymer containing an acrylamide unit; polyacrylic acid; a copolymer containing an acrylic acid unit; polymethacrylic acid; a copolymer containing a methacrylic acid unit; a copolymer of vinyl methyl ether and maleic anhydride; a copolymer of vinyl acetate and maleic anhydride; and phosphoric acid-modified starch. Of those, gum arabic is preferable because of its strong desensitizing action. The hydrophilic organic polymer compounds may be used as required in combination of two or more thereof. The total concentration of the compounds used is preferably about 1 to 40 wt %, and more preferably 3 to 30 wt %.

Specific examples of the hexametaphosphate include alkali metal salts and ammonium salt of hexametaphosphoric acid. Examples of the alkali metal salts and ammonium salt of hexametaphosphoric acid include sodium hexametaphosphate, potassium hexametaphosphate, and ammonium hexametaphosphate. Specific examples of the phytate include alkali metal salts such as sodium salt, potassium salt, and lithium salt; ammonium salt; and amine salts. Examples of the amine salts include salts such as diethylamine, triethylamine, n-propylamine, di-n-propylamine, tri-n-propylamine, n-butylamine, n-amylamine, n-hexylamine, laurylamine, ethylenediamine, trimethylenediamine, tetramethylenediamine, pentamethylenediamine, hexamethylenediamine, ethanolamine, diethanolamine, triethanolamine, allylamine, and aniline. The phytate may be a normal salt obtained by substituting all of 12 hydrogen atoms of phytic acid, or a hydrogen salt (acid salt) obtained by substituting some of hydrogen atoms of phytic acid. The phytate to be used may be a simple salt composed of one base or a double salt containing two or more bases as its components. These compounds may be used alone or in combination of two or more.

It is preferable for the desensitizing solution that may be used in the present invention to further contain a metal salt of a strong acid in order to enhance the desensitizing action of the solution. Specific examples of the metal salt of the strong acid include sodium salts, potassium salts, magnesium salts, calcium salts, and zinc salts of nitric acid, sulfuric acid, and chromic acid; and sodium fluoride and potassium fluoride. The metal salts of the strong acids may be used in combination of two or more, and the amount of the salts is preferably about 0.01 to 5 wt % with respect to the total weight of the desensitizing solution. The pH value of the desensitizing solution to be used in the present invention is preferably adjusted to fall within the acidic range, more preferably within the range of 1 to 5, and most preferably 1.5 to 4.5. Therefore, when the aqueous phase does not have an acidic pH, an acid is further added to the aqueous phase. Examples of the acid to be added as the pH adjustor include mineral acids such as phosphoric acid, sulfuric acid, and nitric acid; and organic acids such as citric acid, tannic acid, malic acid, glacial acetic acid, lactic acid, oxalic acid, p-toluenesulfonic acid, and an organic phosphonic acid. Of those, phosphoric acid is particularly excellent because it not only functions as the pH adjustor but also has the effect of enhancing the desensitizing action. The desensitizing solution preferably contains 0.01 wt % and most preferably 0.1 to 10 wt % of phosphoric acid with respect to the total weight of the desensitizing solution.

The desensitizing solution to be used in the present invention preferably contains at least one of a wetting agent and a surfactant to improve the application property of the desensitizing solution. Specific examples of the wetting agent that may be preferably used include lower polyalcohols such as ethylene glycol, diethylene glycol, triethylene glycol, propylene glycol, butylene glycol, pentanediol, hexylene glycol, tetraethylene glycol, polyethylene glycol, dipropylene glycol, tripropylene glycol, glycerin, sorbitol, and pentaerythritol. Of those, glycerin is particularly preferable. Further, examples of the surfactant that may be used include nonionic surfactants such as polyoxyethylene alkylphenyl ether and polyoxyethylene-polyoxypropylene block copolymer; anionic surfactants such as fatty acid salts, alkyl sulfates, alkylbenzene sulfonates, alkylnaphthalene sulfonates, dialkyl sulfosuccinates, alkyl phosphates, and naphthalene-sulfonate formalin condensates; and amphoteric surfactants such as a betaine amphoteric surfactant, a glycine amphoteric surfactant, an alanine amphoteric surfactant, and a sulfobetaine amphoteric surfactant. The desensitizing solution preferably contains at least one of the wetting agent and the surfactant in an amount of about 0.5 to 10 wt % and more preferably 1 to 5 wt % with respect to the total weight of the desensitizing solution. The desensitizing solution to be used in the present invention may further contain up to 2 wt % of a filler such as silicon dioxide, talc or clay, or up to 1 wt % of a dye or a pigment.

The desensitizing solution to be used in the present invention is composed of the hydrophilic aqueous solution as described above, but desensitizing solutions of emulsion type as described in U.S. Pat. No. 4,253,999, U.S. Pat. No. 4,268,613 and U.S. Pat. No. 4,348,954, and the like may also be used. The amount of desensitizing solution applied and dried is 0.001 to 50 g/m$^2$, and preferably 0.01 to 10 g/m$^2$.

The inkjet drawing method and device of the present invention have been described above in detail. However, the present invention is not limited to the above-mentioned embodiments, and various modifications and changes may of course be made without departing from the gist of the present invention.

For example, the UV ink has been used as ink in this embodiment. However, this is not the sole case of the present invention, and various kinds of photocurable ink for which visible light or infrared light can be used as light for curing may be used. With regard to the light source, various active light sources each emitting active light such as visible light may be used.

In addition, in each of the above-mentioned embodiments, an example in which the present invention is applied to a plate making apparatus using a printing base plate as an image recording medium has been described in detail. However, the present invention is not limited to this but may of course be applied to various drawing apparatuses and image recording apparatuses.

What is claimed is:

1. An inkjet drawing device for recording an image on a sheet-like image recording medium, comprising:

a support for supporting said image recording medium;

an inkjet head for ejecting photocurable ink as an ink droplet imagewise onto said image recording medium placed on said support, said inkjet head being disposed to be opposed to said support;

a head moving mechanism for moving said inkjet head in a main scanning direction;

a scanning active light irradiation section for scanning and irradiating said image recording medium with an active light beam in the main scanning direction to cure said photocurable ink ejected onto said image recording medium, said scanning active light irradiation section being disposed to be opposed to said support and to be on a transport downstream side of said image recording medium so that said scanning active light irradiation section is distant from said inkjet head by a predetermined distance; and a transport mechanism for transporting said image recording medium in a sub-scanning direction substantially perpendicular to the main scanning direction relative to said inkjet head, wherein said scanning active light irradiation section has:

a point or substantially point active light source for emitting said active light beam;

parallel light producing means for producing said active light beam emitted from said active light source as parallel light parallel to a recording surface of said image recording medium supported by said support;

a scanning mirror which reflects said parallel light produced by said parallel light producing means toward a side of said image recording medium and which is movable in the main scanning direction;

a mirror movement mechanism for moving said scanning mirror in the main scanning direction; and wherein said mirror movement mechanism has:

two transport rollers disposed on both sides outside said image recording medium in the main scanning direction;

an endless belt which is suspended between said two transport rollers and to which said scanning mirror is attached and inclined by a predetermined angle; and an irradiation window which is formed to be adjacent to a position where said scanning mirror is attached in a belt portion of said endless belt on the side of said image recording medium and through which irradiation light reflected by said scanning mirror is transmitted.

2. The inkjet drawing device according to claim 1, wherein said scanning active light irradiation section further has two mirror surface plates which are disposed on both sides of said endless belt in the sub-scanning direction and inner portions of which are opposed to each other and constitute mirror finished surfaces, said parallel light producing means has a reflector having an emission port with a rectangular sectional shape for emitting said active light beam emitted from said active light source as said parallel light with a rectangular sectional shape, said active light source and said reflector are disposed between two parallel belt portions of said endless belt and outside said image recording medium in the main scanning direction, inner portions opposed to each other of two parallel belt portions of said endless belt constitute mirror finished surfaces, said scanning minor is attached inside a belt portion on a side of said support out of said two parallel belt portions and inclined by said predetermined angle, said irradiation window is formed at a position of said belt portion on said side of said support through which said irradiation light reflected by said scanning mirror is transmitted, and a waveguide with a rectangular sectional shape for guiding said parallel light with the rectangular sectional shape emitted from said emission port of said reflector is formed between said two parallel belt portions of said endless belt and between said two minor surface plates.

3. The inkjet drawing device according to claim 2, wherein said endless belt is a stainless belt in which said inner portions opposed to each other of said two belt portions are said mirror finished surfaces.

4. The inkjet drawing device according to claim 1, further comprising:

an irradiation section moving mechanism for moving said scanning active light irradiation section in the sub-scanning direction relative to said inkjet head; and a controller for controlling said irradiation section moving mechanism, or said head moving mechanism and said irradiation section moving mechanism so that said scanning active light irradiation section and said inkjet head are distant from each other by the predetermined distance or longer.

5. The inkjet drawing device according to claim 4, wherein said controller changes a moving speed of said scanning mirror based on a quantity of light emitted from said active light source.

6. The inkjet drawing device according to claim 4, wherein said controller changes the moving speed of said scanning mirror in multiple stages.

7. The inkjet drawing device according to claim 4, wherein said irradiation section moving mechanism moves said active light source or said scanning active light irradiation section at a speed different from a relative moving speed between said image recording medium and said inkjet head.

8. The inkjet drawing device according to claim 1, wherein said transport mechanism is a mechanism for transporting said image recording medium in the sub-scanning direction.

9. The inkjet drawing device according to claim 1, wherein said predetermined distance is a distance in which an influence of heat by said active light source does not affect the drawing by said inkjet head.

10. The inkjet drawing device according to claim 1, wherein said predetermined distance is determined in accordance with at least one of a speed of the drawing by said inkjet head, types or structures of said inkjet head and said active light source, a speed at which said image recording medium is transported in the sub-scanning direction relative to said inkjet head, a material or quality of the material of said image recording medium, and a quantity of said active light beam applied from said active light source.

11. The inkjet drawing device according to claim 1, wherein said image recording medium on which said image is recorded is a lithographic printing plate.

12. The inkjet drawing device according to claim 1, wherein said image recording medium is a lithographic printing base plate, and said inkjet drawing device further comprises a plate surface protective solution ejection head for ejecting a plate surface protective solution onto said printing base plate subjected to drawing by said inkjet head.

13. The inkjet drawing device according to claim 12, wherein said lithographic printing base plate has an aluminum support having an anodized layer, a hydrophilic layer formed on said anodized layer of said aluminum support and an ink receiving layer formed on said hydrophilic layer.

14. An inkjet drawing method for directly forming an image on a sheet-like image recording medium relatively transported in a sub-scanning direction perpendicular to a main scanning direction by using photocurable ink with a serial type inkjet head moving in the main scanning direction, comprising steps of:

causing said inkjet head to eject the photocurable ink as an ink droplet imagewise to perform direct drawing;

irradiating an upper portion of said image recording medium with active light from a stationary, point or substantially point active light source by using a scanning mirror that scans and moves in the main scanning direction at a backward position distant from a position subjected to the drawing by said inkjet head by a predetermined distance toward a sub-scanning transport downstream side of said image recording medium; and curing the photocurable ink ejected onto said image recording medium imagewise to form said image; and providing a mirror moving device including:

two transport rollers disposed on both sides outside said image recording medium in the main scanning direction;

an endless belt which is suspended between said two transport rollers and to which said scanning mirror is attached and inclined by a predetermined angle; and an irradiation window which is formed to be adjacent to a position where said scanning mirror is attached in a belt portion of said endless belt on the side of said image recording medium and through which irradiation light reflected by said scanning mirror is transmitted.

15. The inkjet drawing method according to claim 14, wherein said predetermined distance is a distance in which an influence of heat by said active light source does not affect the drawing by said inkjet head.

16. The inkjet drawing method according to claim 14, wherein said predetermined distance is determined in accordance with at least one of a speed of the drawing by said inkjet head, types or structures of said inkjet head and said active light source, a speed at which said image recording medium is transported in the sub-scanning direction relative to said inkjet head, a material or quality of the material of said image recording medium, and a quantity of said active light beam applied from said active light source.

17. The inkjet drawing method according to claim 14, wherein said active light includes ultraviolet light, visible light and infrared light, and said photocurable ink is ink cured by being irradiated with said active light.

18. The inkjet drawing method according to claim 14, wherein ultraviolet light is used as said active light, and ultraviolet curable ink is used as said photocurable ink.

* * * * *